US007796925B2

(12) United States Patent
Oda

(10) Patent No.: US 7,796,925 B2
(45) Date of Patent: Sep. 14, 2010

(54) DEVELOPER HOLDER, IMAGE FORMING UNIT, AND IMAGE FORMING APPARATUS

(75) Inventor: Yukiyoshi Oda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 866 days.

(21) Appl. No.: 11/668,667

(22) Filed: Jan. 30, 2007

(65) Prior Publication Data

US 2007/0177903 A1 Aug. 2, 2007

(30) Foreign Application Priority Data

Jan. 31, 2006 (JP) ..... 2006-023366

(51) Int. Cl.
*G03G 15/08* (2006.01)

(52) U.S. Cl. ..... 399/263; 399/120

(58) Field of Classification Search ..... 399/262, 399/263, 120

See application file for complete search history.

(56) References Cited

U.S. PATENT DOCUMENTS 5,913,097 A * 6/1999 Nakano et al. ..... 399/256
6,553,202 B2 * 4/2003 Tamaki et al. ..... 399/258
7,558,514 B2 * 7/2009 Yamamura ..... 399/256
2005/0008400 A1 * 1/2005 Tazawa et al. ..... 399/263

FOREIGN PATENT DOCUMENTS

JP 11-024401 1/1999

* cited by examiner

*Primary Examiner*—David M Gray
*Assistant Examiner*—Joseph S Wong
(74) *Attorney, Agent, or Firm*—Rabin & Berdo, PC

(57) ABSTRACT

A developer cartridge holds toner therein. A chamber is A shutter rotates in slide contact with the arcuate surface of the chamber, being movable either to a closing position where the shutter closes the first opening or to an opening position where the shutter opens the first opening. A rotating shaft is rotatably supported in the chamber. A resilient scraper blade has one end fixed to the rotating shaft and extends from the rotating shaft to scrape the arcuate surface when the rotating body rotates. When the scraper blade extends through the first opening, the scraper blade extends in a direction at an angle with a line tangent to an arcuate plane in which the arcuate surface lies, the scraper blade. The angle is in the range of 30 to 70 degrees.

21 Claims, 21 Drawing Sheets

WHEN $\theta > 70^\circ$

WHEN $L_3 - L_4 < L_1 - L_2$

DEVELOPER HOLDER, IMAGE FORMING UNIT, AND IMAGE FORMING APPARATUS

BACKGROUND OF THE INVENTION

1. Field of the Invention

The present invention relates to a developer holder, an image forming unit, and an image forming apparatus.

2. Description of the Related Art

A conventional image forming apparatus such as a printer, a copying machine, a facsimile machine, or a multi-function printer includes an image forming unit. The image forming unit includes a photoconductive drum on which an electrostatic latent image is formed. The electrostatic latent image is developed with toner into a toner image. A toner cartridge holds toner therein and is detachably attached to the image forming unit.

The toner cartridge includes a toner chamber having an exit formed therein and a shutter that closes the exit. When the shutter is opened, the toner is discharged through the exit.

An agitating member is disposed in the toner chamber. The agitating member includes scraperblades in the form of a resilient sheet. The scraper blades scrape the toner adhering to an inner wall of the toner chamber.

When the shutter is closed and opened, the scraper blades may be caught in a gap between the shutter and a chamber wall, preventing the shutter from operating properly. Improper operation of the shutter causes leakage of toner, deterioration of the scraper blades, or shorter lifetime of the toner cartridge.

SUMMARY OF THE INVENTION

An object of the invention is to solve the problems of conventional art.

Another object of the inventions is to provide a developer holder, an image forming unit, and an image forming apparatus.

A developer cartridge includes:

a chamber holding a developer therein and including an inner surface and a first opening through which the developer is discharged;

a shutter movable in slide contact with the surface of the chamber, the shutter being movable either to a closing position where the shutter closes the first opening or to an opening position where the shutter opens the first opening;

a rotating body rotatably supported in the chamber;

a resilient scraper blade having one end fixed to the rotating body and extending away from the rotating body, a free end of the scraper blade scraping the surface when the rotating body rotates, wherein when the resilient scraper blade extends in a first direction through the first opening and a plane in which the surface lies, the first direction forming an acute angle with a line tangent to the plane at a position where the scraper blade 57 extends through the plane.

The angle is not larger than 70 degrees.

The angle is not smaller than 30 degrees.

The scraper blade and shutter are related such that $$L3-L4>L1-L2$$

where L1 is a total length of the scraper blade,

L2 is a distance from the one end fixed to the rotating body to the plane when the scraper blade extends in the first direction through the plane, L3 is a distance over which the shutter moves from the opening position to the closing position, and L4 is a distance over which the shutter moves across the first opening.

When the shutter is at the closing position, the shutter and the chamber define a space between the inner surface and the shutter.

The space is defined by a stepped portion recessed from the inner surface of the chamber.

The scraper blade and the shutter are related such that $$L6>L1-L5$$

$$L7>L8$$

where L1 is a total length of the scraper blade,

L5 is a distance from the one end fixed to the rotating body to a bottom of the stepped portion, L6 is a distance over which the stepped portion extends substantially in a second direction in which the shutter moves from the closing position to the opening position, the stepped portion extending such that when said shutter moves in the second direction, said shutter faces stepped portion (75), extending L7 is a depth of the stepped portion, and L8 is a thickness of the scraper blade.

The shutter includes a stepped portion recessed from a surface of the shutter facing the inner surface of the chamber.

The scraper blade and the shutter are related such that $$L10>L1-L9$$

$$L11>L8$$

where L1 is a total length of the scraper blade,

L9 is a distance from the one end fixed to the rotating body to a bottom of the stepped portion, L10 is a distance over which the stepped portion extends substantially in a second direction in which the shutter moves from the closing position to the opening position, the stepped portion extending such that when said shutter moves in the second direction, said shutter faces stepped portion (75), L11 is a depth of the stepped portion, and L8 is a thickness of the scraper blade.

The scraper blade is a sheet of a resilient material.

An image forming unit incorporates the aforementioned developer cartridge. The image forming unit includes a developer bearing body that bears developer thereon, and a developer supplying member that supplies the developer to the developer bearing body.

An image forming apparatus incorporates the aforementioned developer cartridge. The image forming apparatus includes an image forming unit that forms a developer image; a transfer section that transfers the developer image onto a medium; and a fixing section that fixes the developer image on the medium into a permanent image.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{Construction}

Figure 1:
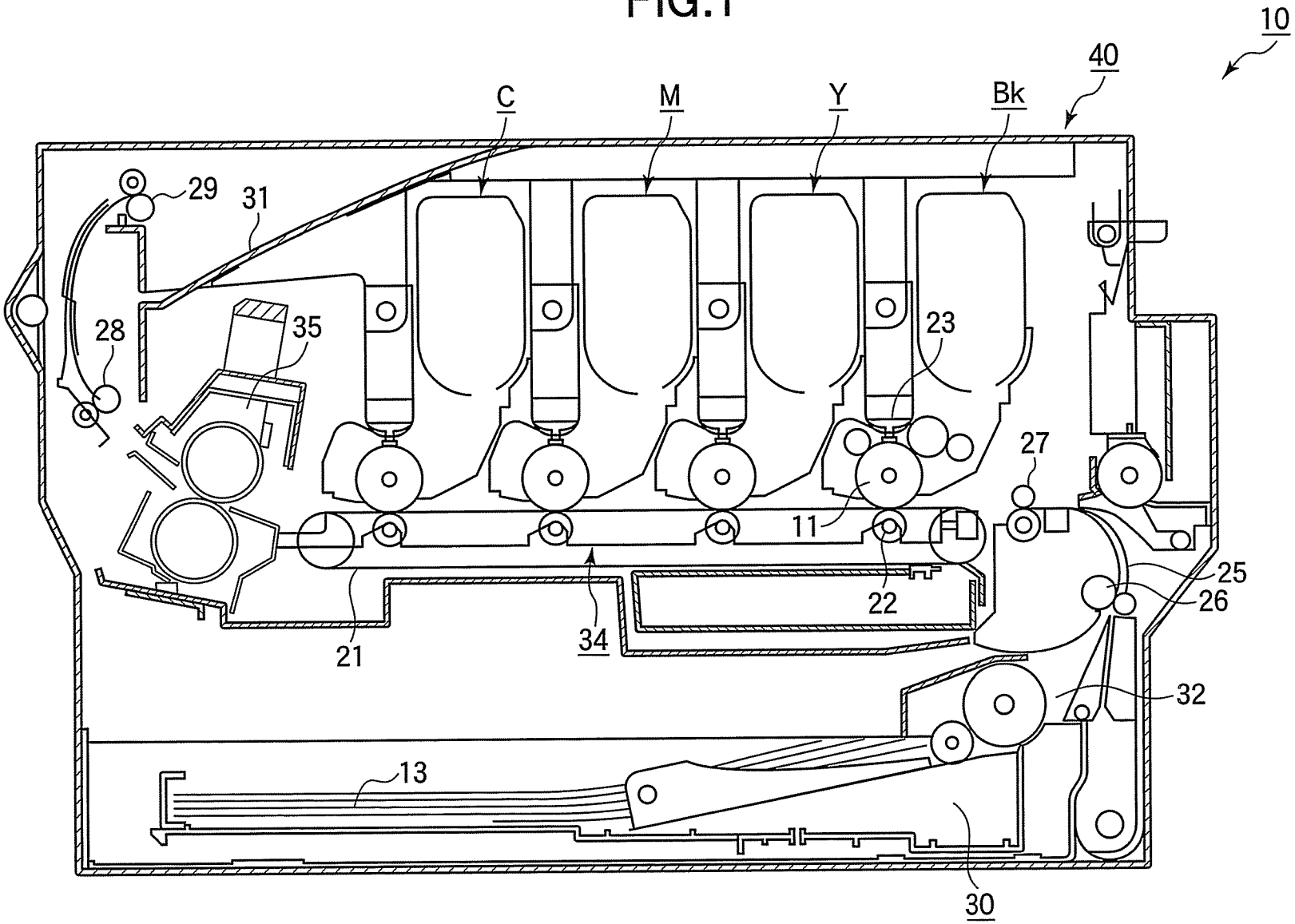
FIG. 1 illustrates a general configuration of a printer of a first embodiment.

FIG. 1 illustrates a general configuration of a printer of a first embodiment.

Referring to FIG. 1, a transport path 25 runs generally in the shape of an "S" in an image forming apparatus 10, and transports paper 13 (FIG. 2) within the image forming apparatus 10. Transport rollers 26-29 are disposed along the transport path 25. Image forming units BK (black), Y (yellow), M (magenta), and C (cyan) are arranged in this order along the transport path 25.

Each of the image forming units includes a photoconductive drum 11 and an LED head 23 that parallels the photoconductive drum 11. A fixing unit 35 is located downstream of a transfer unit 34, and fixes the toner image on the paper 13 into a permanent image.

The transfer unit 34 is disposed under the image forming units BK, Y, M, and C to define transfer points between respective photoconductive drums 11 and the transfer unit 34 through which the paper 13 passes. The transfer unit 34 transports the paper 13 through the image forming units BK, Y, M, and C, and transfers toner images of the respective colors onto the paper 13 as the paper 13 passes through the respective transfer points.

The transfer unit 34 includes an endless transfer belt 21 that runs and transfer rollers 22, which are located on the inside of the transfer belt 21 and parallel the photoconductive drum 11. When a predetermined voltage is applied to the transfer roller 22, the transfer roller 22 transfers the toner image of a corresponding color from the photoconductive drum 11 onto the paper 13.

An upper frame 40 is formed with a stacker 31 on which pages of the discharged paper 13 are stacked after fixing. A paper cassette 30 holds a stack of the paper 13. A paper feeding mechanism 32 feeds the paper 13 into the transport path 25.

Figure 2:
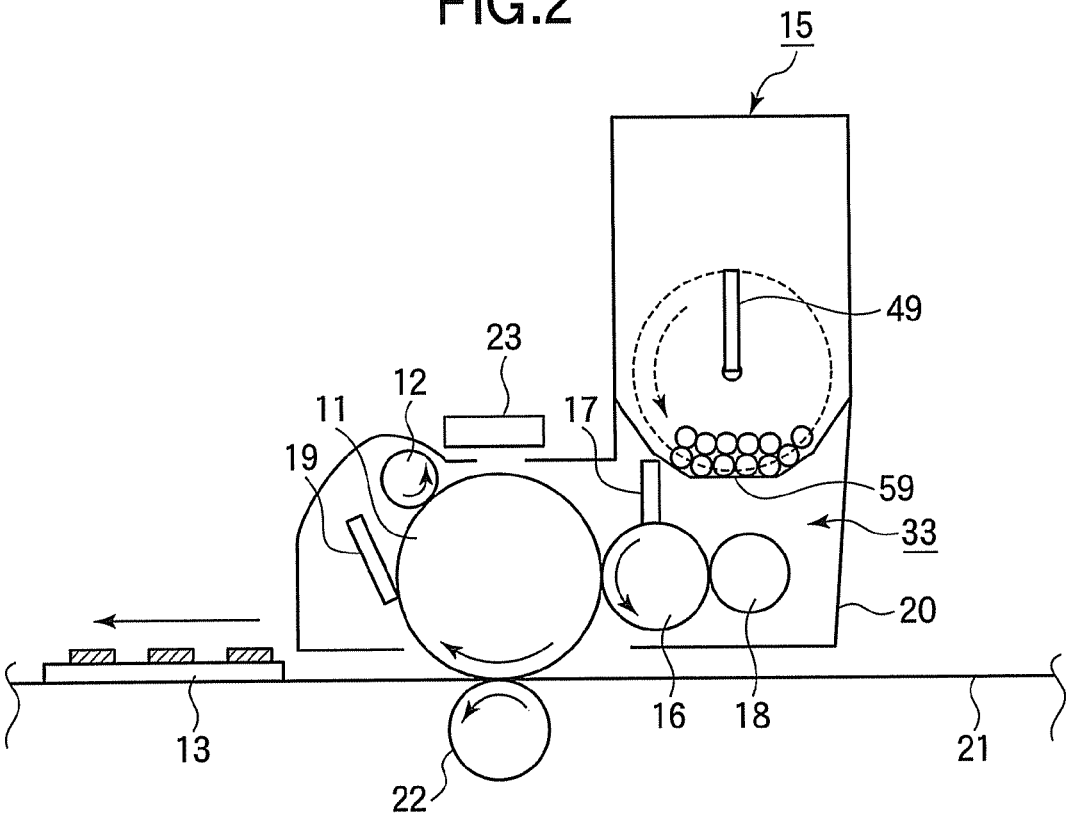
FIG. 2 illustrates a general configuration of an image forming unit BK of the first embodiment.

FIG. 2 illustrates a general configuration of an image forming unit BK of the first embodiment.

Each of the image forming units BK, Y, M, and C may be substantially identical; for simplicity only the image forming unit BK will be described, it being understood that the other image forming units may work in a similar fashion.

Referring to FIG. 2, a charging roller 12 rotates in pressure contact with the photoconductive drum 11 that rotates at a predetermined speed. The charging roller 12 rotates in the opposite direction to the photoconductive drum 11, and charges the circumferential surface of the photoconductive drum 11. The LED head 23 illuminates the charged surface of the photoconductive drum 11 in accordance with image data to form an electrostatic latent image on the photoconductive drum 11.

The image forming unit BK for black includes a developing roller 16, a developing blade 17, and a toner supplying roller 18. The developing blade 17 is in pressure contact with the developing roller 16 to form a thin layer of toner on the developing roller 16. The developing roller 16 is in pressure contact with the photoconductive drum 11, and rotates in the opposite direction to the photoconductive drum 11. The toner supplying roller 18 rotates in contact with the developing roller 16 in the same direction as the developing roller 16. A cleaning blade 19 is formed of a resilient material, and is in contact with the photoconductive drum 11 to scrape residual toner from the photoconductive drum 11 as the photoconductive drum 11 rotates.

The photoconductive drum 11, charging roller 12, and cleaning blade 19 are enclosed by a chassis 20. A toner cartridge 15 is detachably mounted on top of the chassis 20. The toner cartridge 15 has an elongated hole or toner discharging opening 59 formed in its bottom wall. The toner is discharged through the toner discharging opening 59. An agitating bar 49 is rotatably supported in the toner cartridge 15, and agitates the toner in the toner cartridge 15.

{Image forming Unit and Toner Cartridge}

Figure 3:
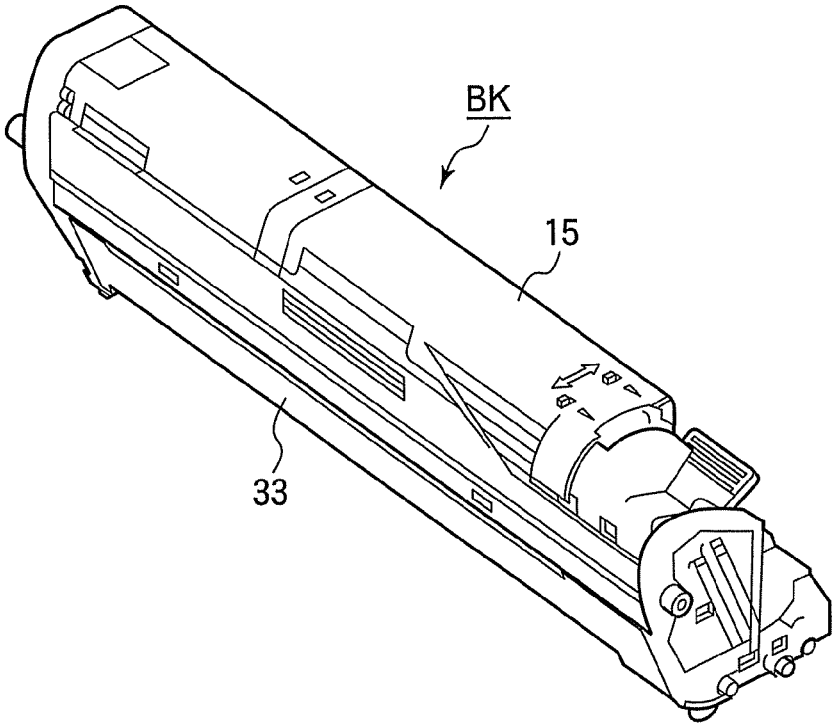
FIG. 3 is a first perspective view of the image forming unit BK to which the toner cartridge is attached.

FIG. 3 is a first perspective view of the image forming unit BK to which the toner cartridge 15 is attached.

Figure 4:
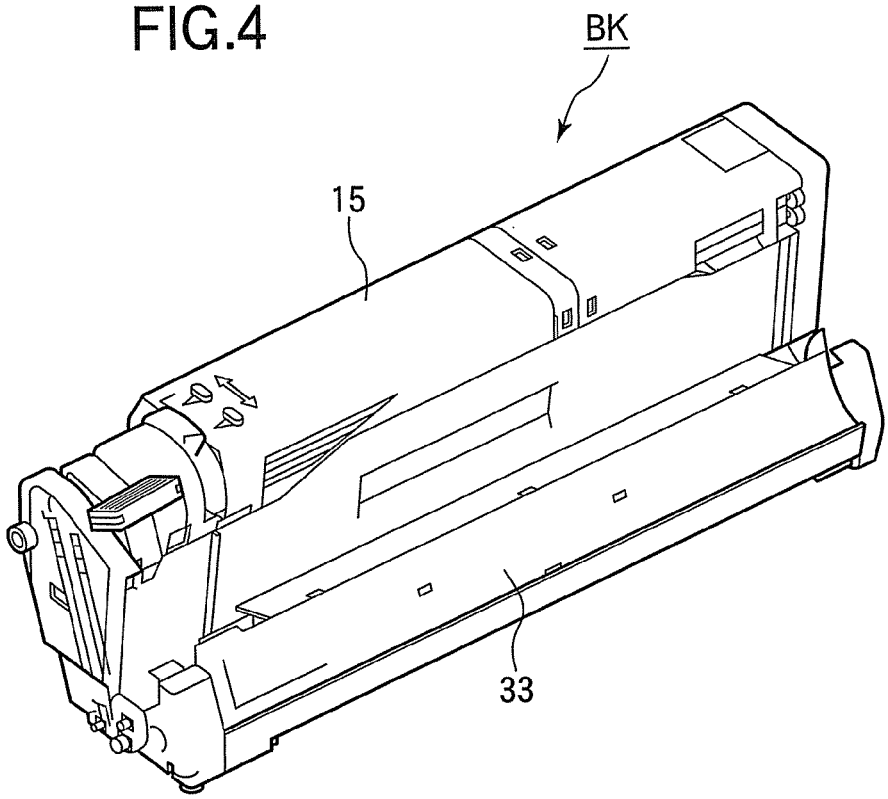
FIG. 4 is a second perspective view of the image forming unit Bk to which the toner cartridge is attached.

FIG. 4 is a second perspective view of the image forming unit Bk to which the toner cartridge 15 is attached.

Figure 5:
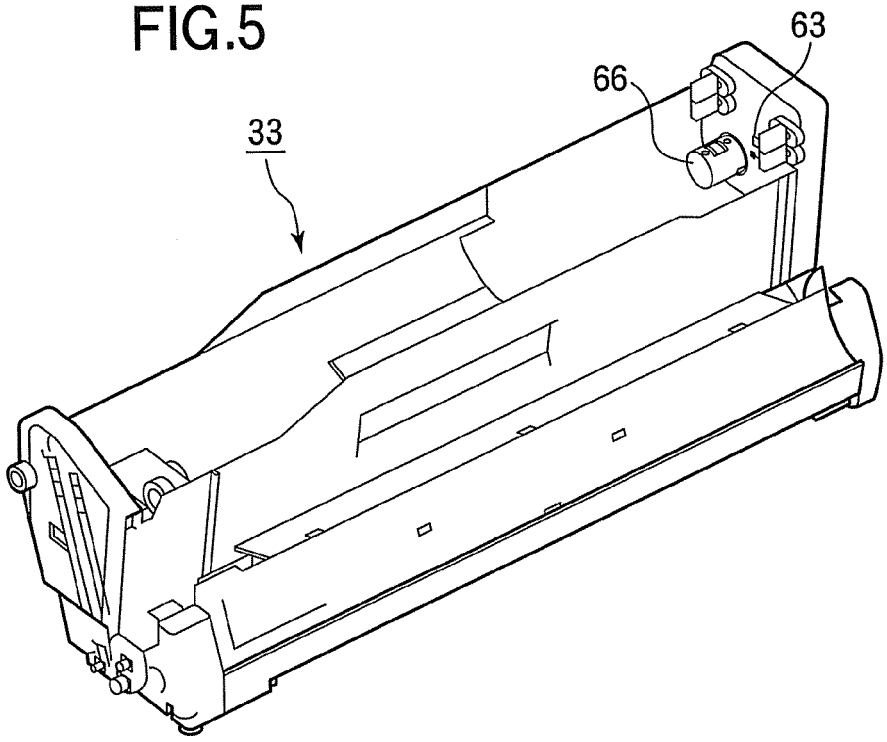
FIG. 5 is a perspective view of a chassis of the image forming unit BK when the toner cartridge has been detached from the image forming unit BK.

FIG. 5 is a perspective view of a chassis 33 of the image forming unit BK when the toner cartridge 15 has been detached from the image forming unit BK.

Figure 6:
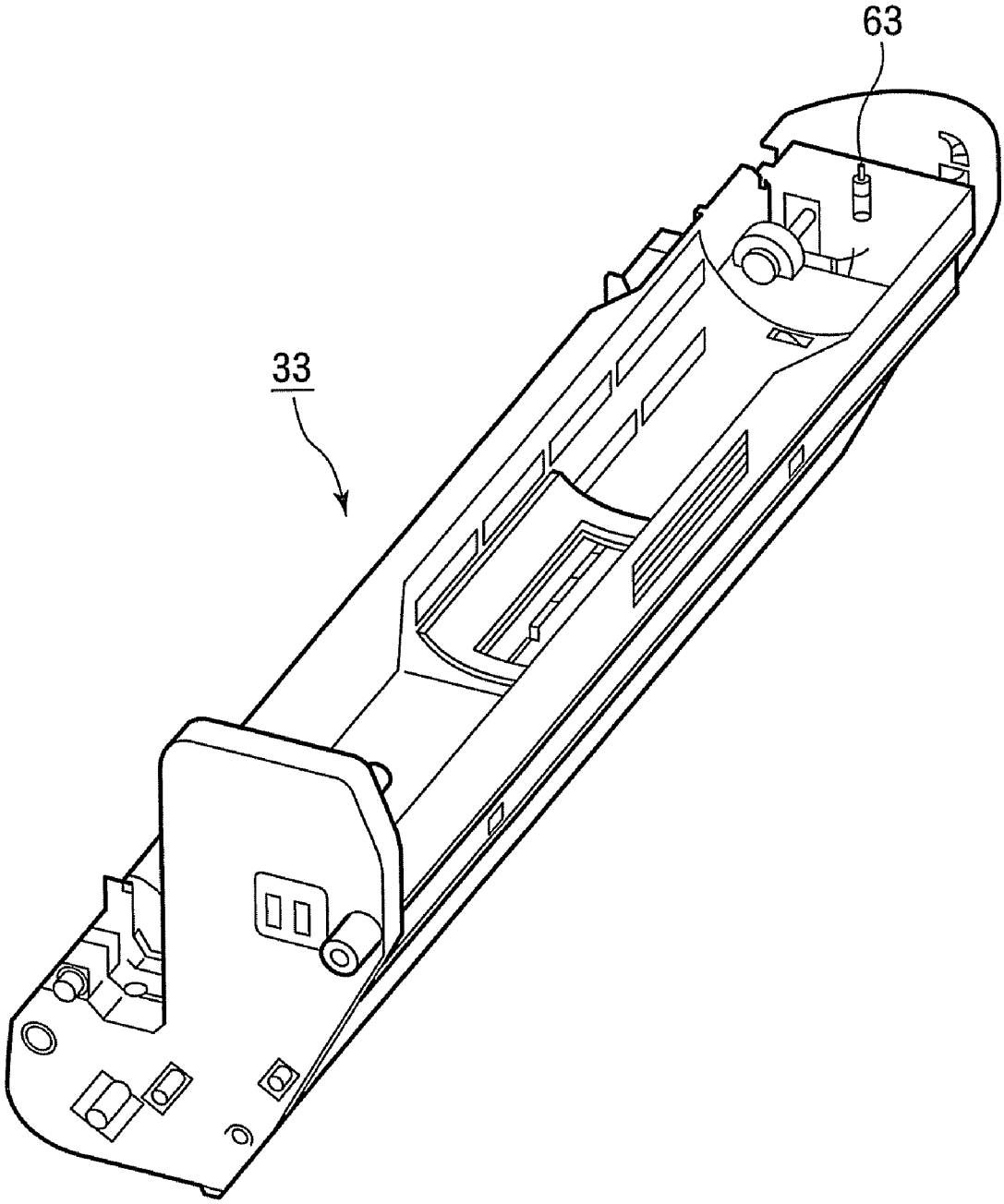
FIG. 6 is another perspective view of the chassis.

FIG. 6 is another perspective view of the chassis 33.

Referring to FIGS. 4 and 5, the toner cartridge 15 for black toner is detachably attached to the image forming unit BK.

Referring to FIGS. 5 and 6, the chassis 33 includes a positioning projection 63 and a waste toner discharging port 66.

Figure 9:
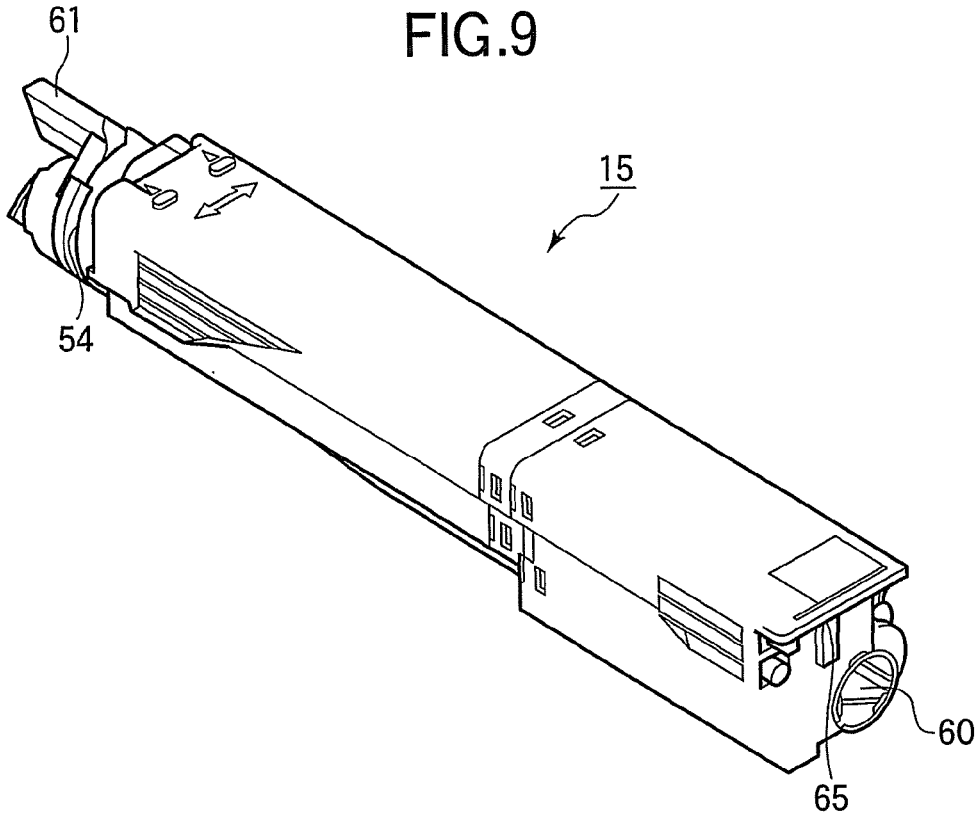
FIGS. 9, 10, and 11 are perspective views of the toner cartridge.
Figure 10:
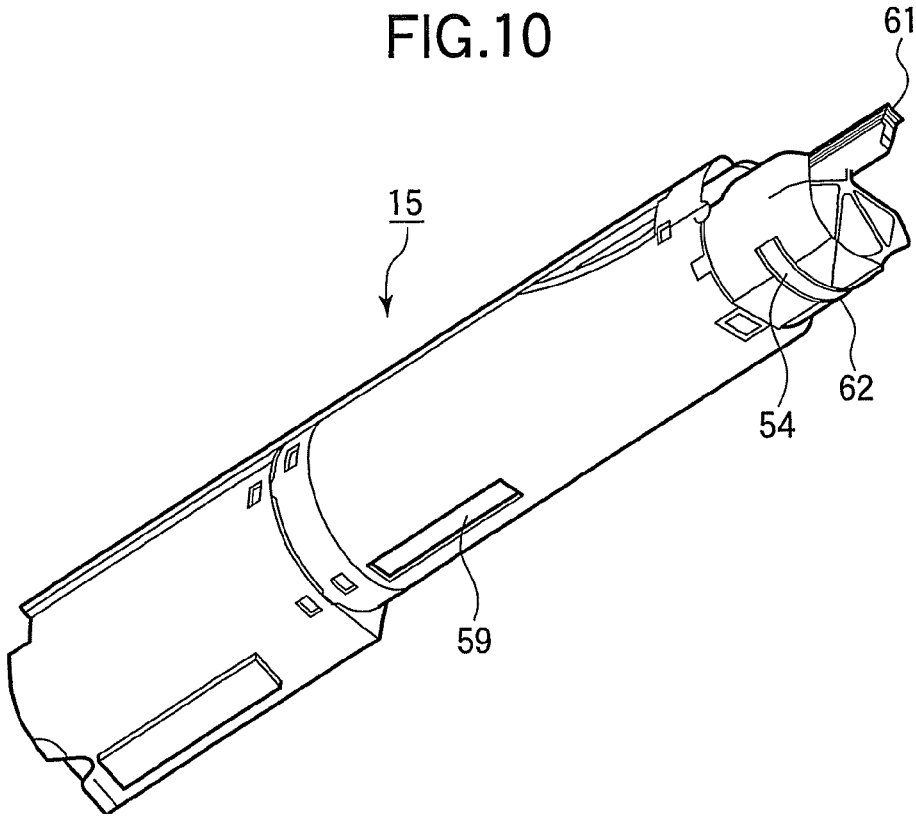
Figure 11:
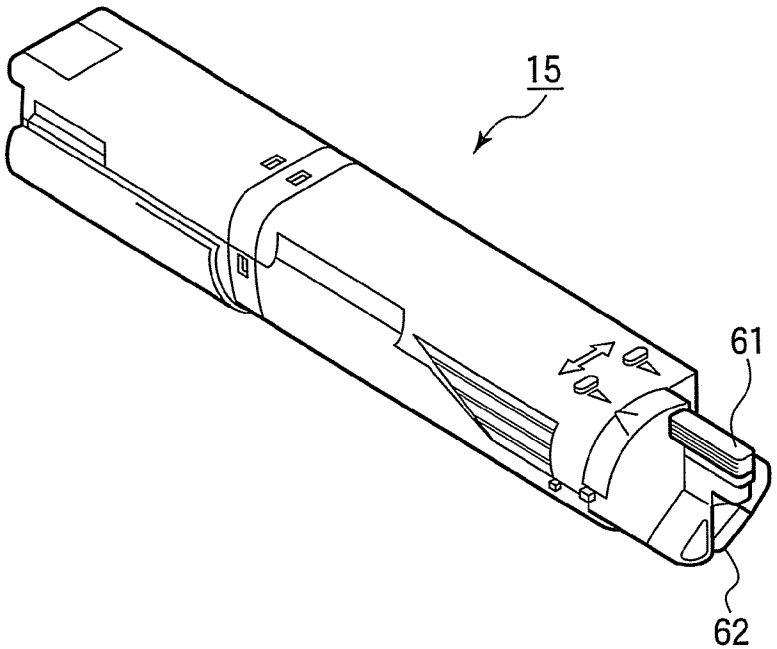

FIGS. 9, 10, and 11 are perspective views of the toner cartridge 15.

Figure 12:
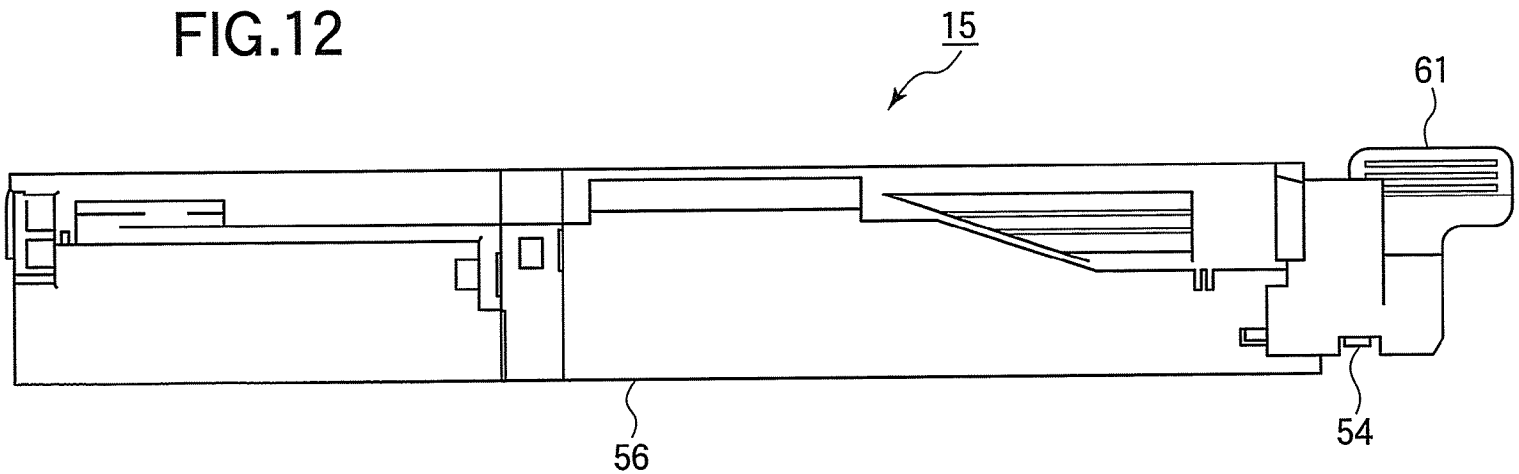
FIG. 12 is a front view of the toner cartridge.

FIG. 12 is a front view of the toner cartridge 15.

Referring to FIG. 9, the toner cartridge 15 includes a waste toner receiving hole 60 that receives the toner discharging port 66 of the chassis 33 when the toner cartridge 15 is attached to the chassis 33.

Figure 15:
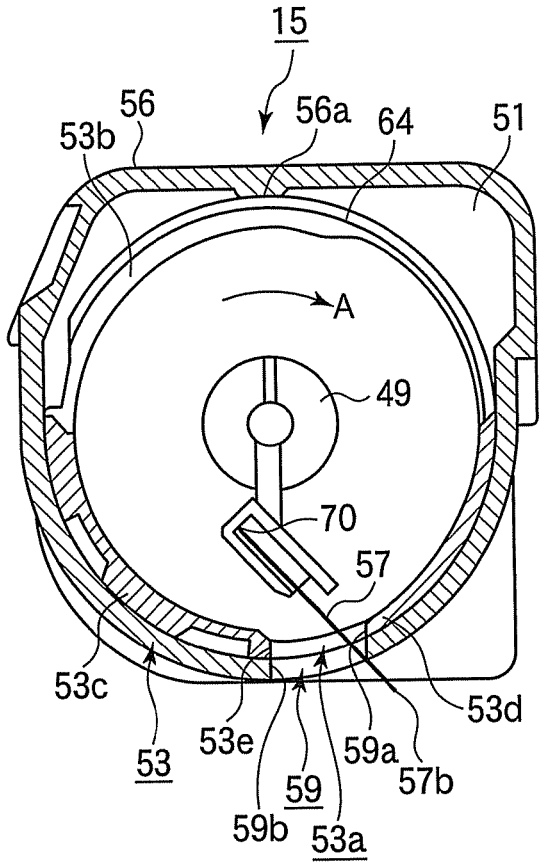
FIG. 15 is a cross-sectional view of the toner cartridge when the shutter is at its opening position.

The toner cartridge 15 includes a longitudinally extending chassis 56 that includes a rectangular upper portion and a semi-cylindrical lower portion (FIG. 15).

Figure 7:
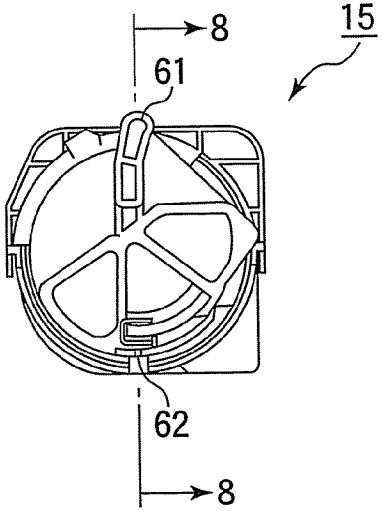
FIG. 7 is a side view of the toner cartridge.

FIG. 7 is a side view of the toner cartridge 15.

Figure 8:
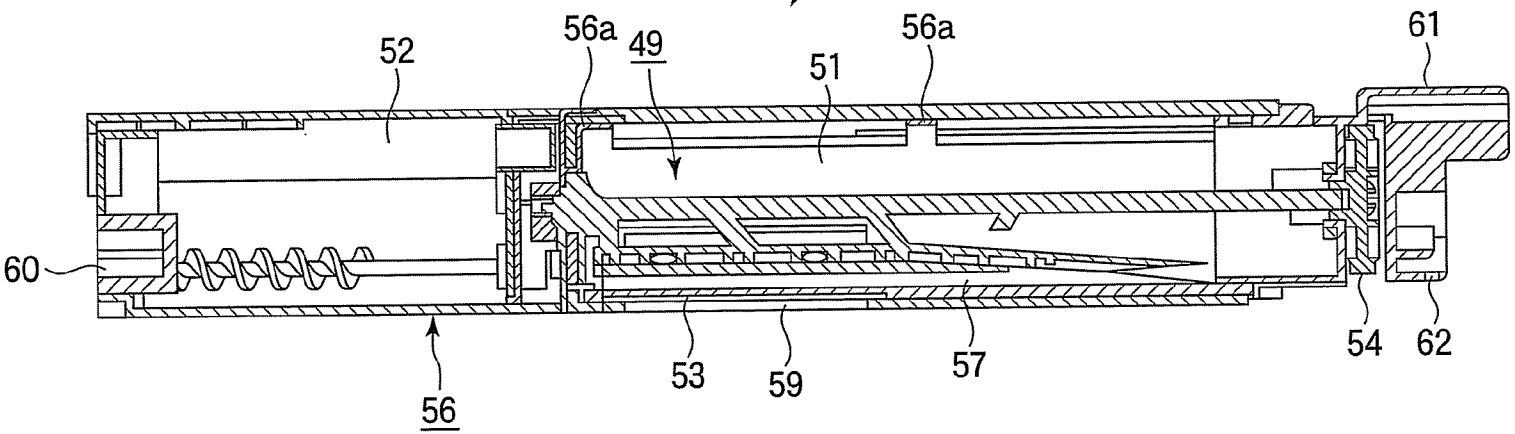
FIG. 8 is a longitudinal cross sectional view of the toner cartridge taken along a line 8-8 of FIG. 7.

FIG. 8 is a longitudinal cross sectional view of the toner cartridge 15 taken along a line 8-8 of FIG. 7.

Referring to FIG. 8, the toner cartridge 15 includes a fresh toner chamber 51 and a waste toner chamber 52. The fresh toner is supplied from the fresh toner chamber 51 into the image forming unit BK. The waste toner is collected from the image forming unit BK, and is received into the waste toner chamber 52.

The fresh toner chamber 51 is open at one longitudinal end, and is closed at another longitudinal end by a rotary lever 61. The lever 61 is in one piece with a shutter 53, and is inserted into the fresh toner chamber 51 from the one longitudinal end of the fresh toner chamber 51 such that the shutter 53 is rotatable relative to the chassis 56. A gear 54 is located at the one longitudinal end of the chassis 56, and is coupled with the agitating bar 49. A drive source, not shown, drives the gear 54 in rotation, and the gear 54 drives the agitating bar 49 in rotation to agitate the fresh toner in the fresh toner chamber 51.

The agitating bar 49 includes a scraper blade 57 in the shape of a resilient sheet. As the agitating bar 49 rotates, the scraper blade 57 scrapes the inner wall surface of the fresh toner chamber 51 to remove the toner adhering to the inner wall surface of the fresh toner chamber 51.

The scraper blade 57 is formed of a PET film having a thickness of 0.1 mm, and is secured at its one end portion to the agitating bar 49.

The toner cartridge 15 includes the toner discharging opening 59 formed in a bottom wall of the chassis 56, the toner discharging opening 59 extending in the longitudinal direction of the toner cartridge 15.

Figure 13:
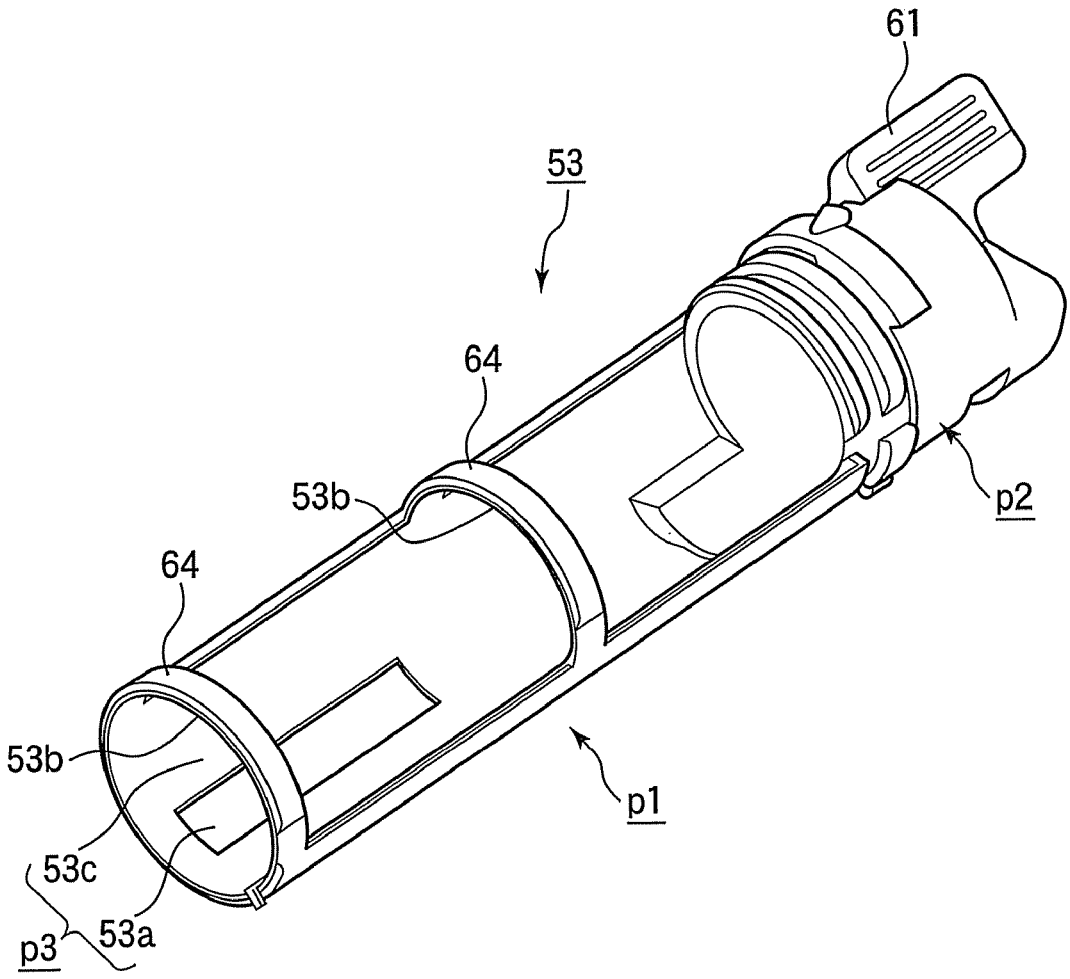
FIG. 13 is a perspective view of the shutter.

FIG. 13 is a perspective view of the shutter 53. Referring to FIG. 13, the shutter 53 is generally in the shape of a cylinder having an open longitudinal end and a closed longitudinal end. The shutter 53 includes an arcuate bottom wall P1 that moves in sliding contact with the inner circumferential wall of the fresh toner chamber 51, and a longitudinal end wall P2 that is in one piece with the bottom wall P1 and has the lever 61 formed thereon. Two arcuate bridges 53*b* are formed across circumferential ends of the arcuate wall P1 such that the arcuate wall P1 and the arcuate bridge 53*b* form a short cylinder. A sliding portion 64 is in one piece with the outer surface of the arcuate bridge 53*b*. The bottom wall P1 is formed with an opening 53*a* with a shutter element 53*c* defined adjacent to the opening 53*a*.

When a user operates the lever 61 to rotate the shutter 53 in such a direction as to move the opening 53*a* into alignment with the toner discharging opening 59, the toner is discharged through the opening 53*a* and the toner discharging opening 59 of the chassis 56 from the fresh toner chamber 51 into the image forming unit BK.

When the user operates the lever 61 to rotate the shutter 53 toward the closing position (FIG. 16), the opening 53 rotates out of alignment with the toner discharging opening 59 to close the toner discharging opening 59.

The longitudinal end wall P2 includes a groove 62 (FIGS. 10 and 12) formed in its outer circumferential surface. When the toner cartridge 15 is attached to the image forming unit BK, the groove 62 receives the positioning projection 63 formed on the chassis 33 so that the toner cartridge 15 is accurately positioned relative to the image forming unit BK.

{Shutter and Scraper Blade}

The operation of the shutter 53 will be described.

Figure 14:
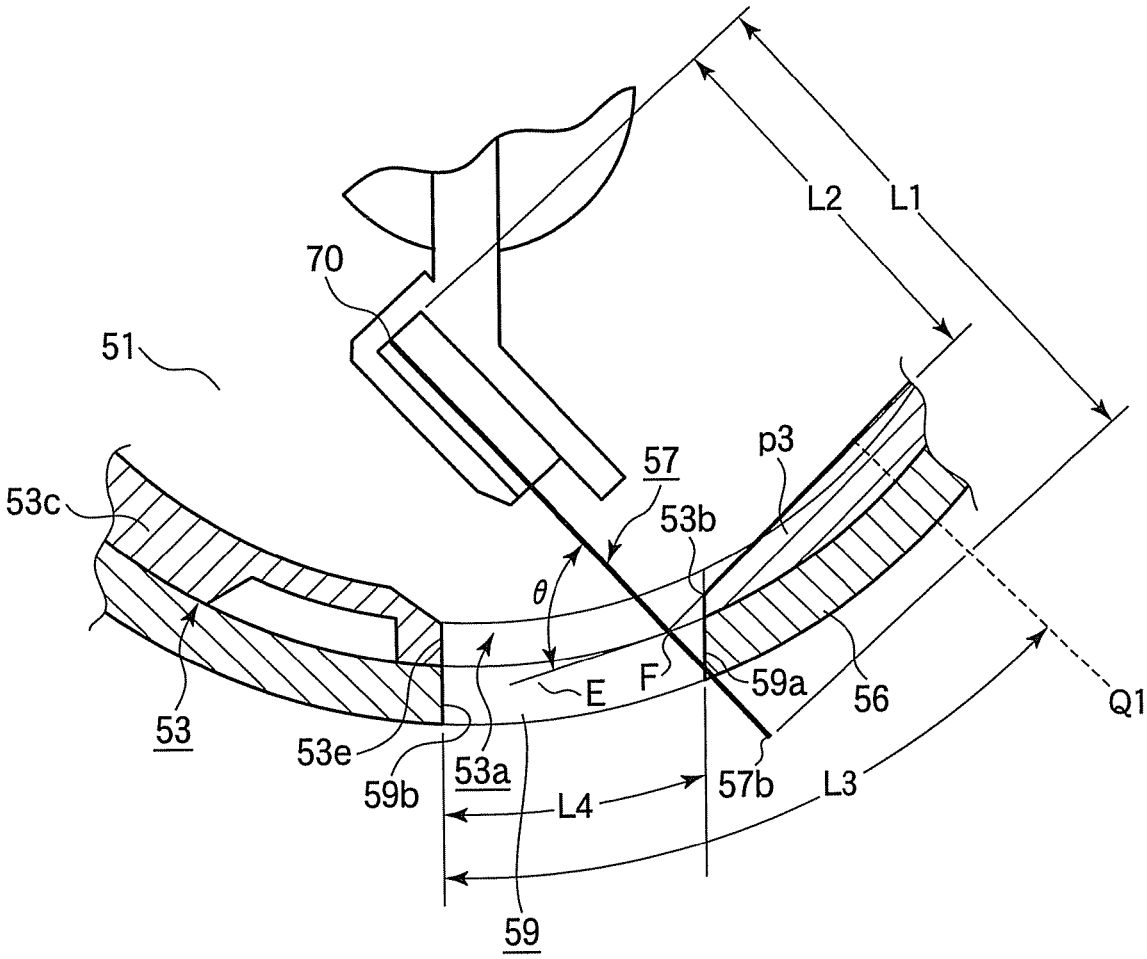
FIG. 14 is an enlarged cross-sectional view of the toner cartridge.

FIG. 14 is an enlarged cross-sectional view of the toner cartridge 15 illustrating the positional relation between the scraper blade 57 and its surroundings.

FIG. 15 is a cross-sectional view of the toner cartridge 15 when the shutter 53 is at its opening position and when the agitating bar 49 is at a rotational position where the scraper blade 57 extends through the openings 53*a* and 59.

Figure 16:
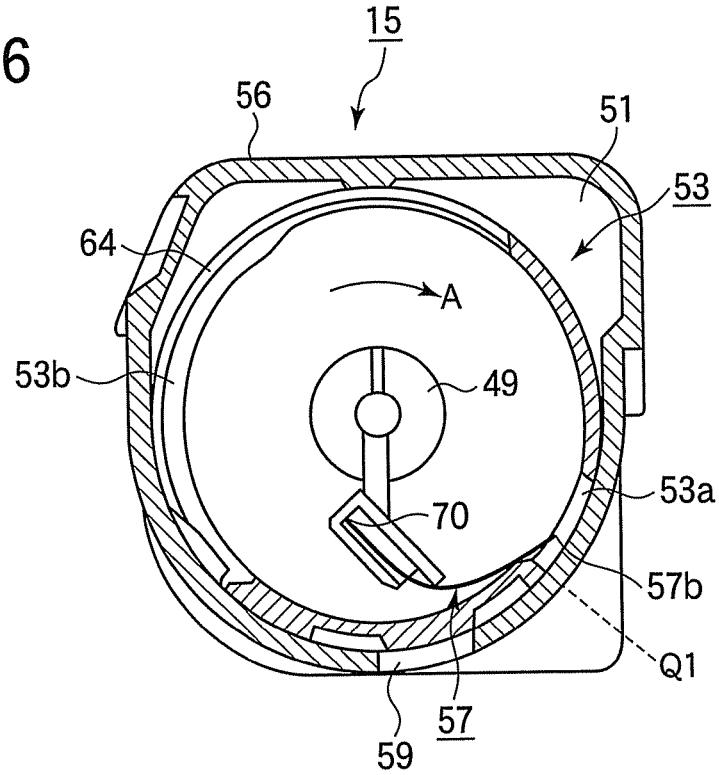
FIG. 16 is a cross-sectional view of the toner cartridge when the shutter has rotated from the opening position in FIG. 15 to its closing position.

FIG. 16 is a cross-sectional view of the toner cartridge 15 when the shutter 53 has rotated from the opening position in FIG. 15 to its closing position.

Referring to FIGS. 14, 15, and 16, a supporting projection 56*a* extends into the fresh toner chamber 51 of the toner cartridge 15 (FIG. 8) to slidably engage the outer sliding portion 64 of the shutter 53, thereby holding the shutter 53 in position. Rotating the shutter 53 in a direction shown by arrow A from the closing position to the opening position causes the opening 53*a* to move into alignment with the toner discharging opening 59. Rotating the shutter 53 from the opening position to the closing position causes the opening 53*a* to move out of alignment with the toner discharging opening 59.

For example, when the toner cartridge 15 needs to be detached from the image forming unit BK for replacement, the user operates the lever 61 to move the shutter 53 to the closing position before taking the toner cartridge 15 from the image forming unit BK.

Figure 17:
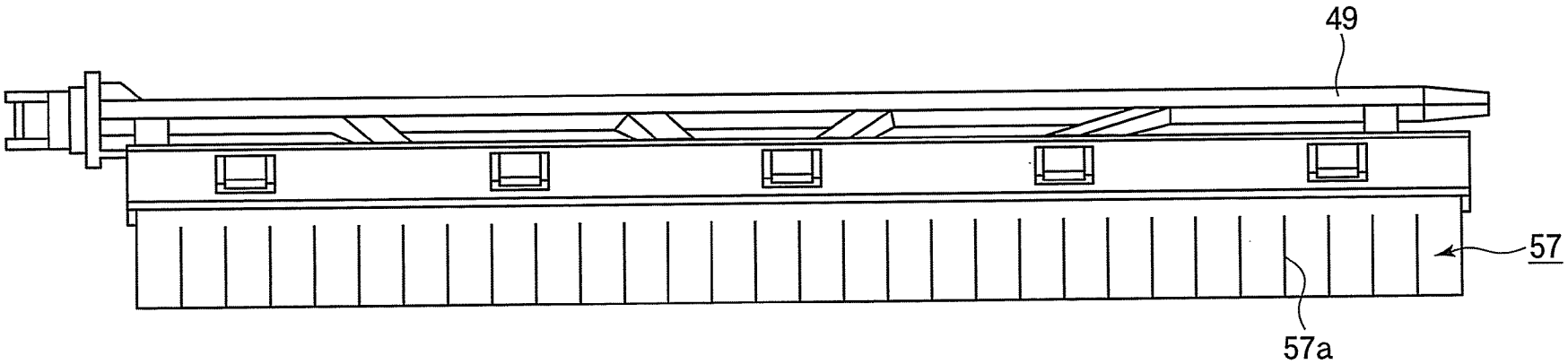
FIG. 17 is a front view of a scraper blade.
Figure 18:
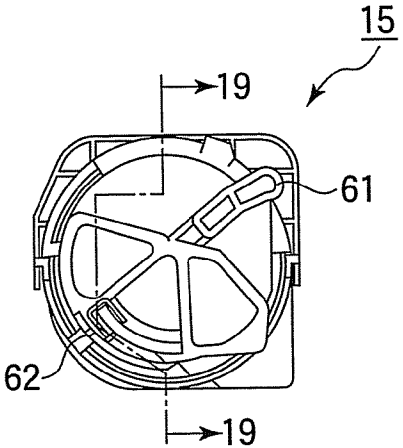
FIG. 18 is a side view of the toner cartridge.
Figure 19:
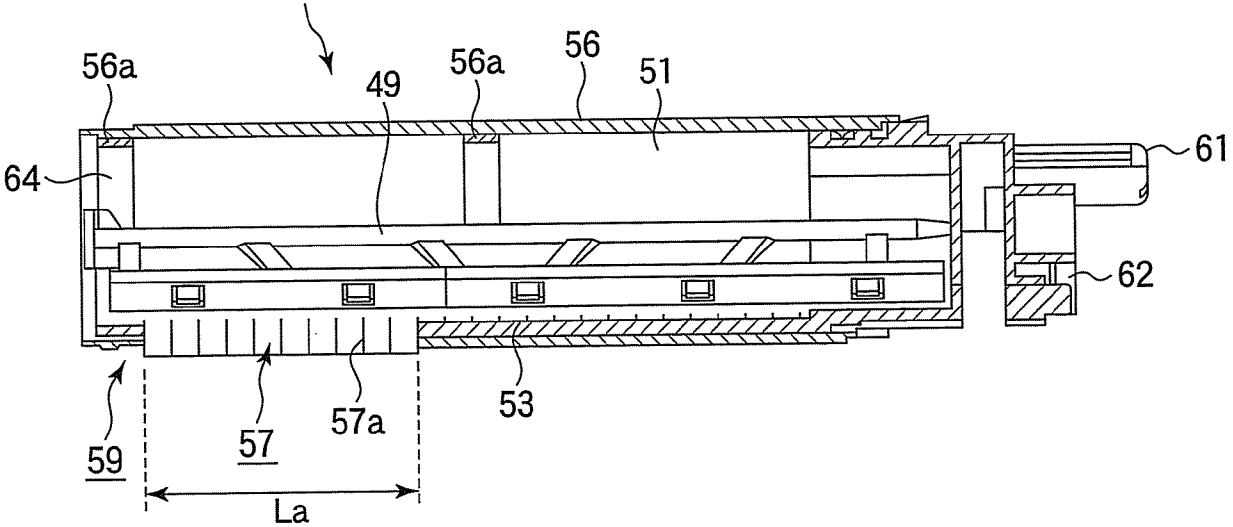
FIG. 19 is a longitudinal cross-sectional side view of the toner cartridge taken along a line 19-19 of FIG. 18.

FIG. 17 is a front view of the scraper blade 57. FIG. 18 is a side view of the toner cartridge 15. FIG. 19 is a longitudinal cross-sectional side view of the toner cartridge 15 taken along a line 19-19 of FIG. 18.

Referring to FIG. 17, the scraper blade 57 extends substantially across the length of the fresh toner chamber 51. The scraper blade 57 has a plurality of slits 57*a* formed at every 5 mm to divide the scraper blade 57 into sub blades 57*c*, each of the slits extending in a direction at an angle with the radial direction of the agitating bar 49 so that a load exerted on the scraper blade 57 is reduced when the scraper blade 57 scrapes the inner wall of the fresh toner chamber 51.

As the agitating bar 49 rotates, the tips 57*b* of the sub blades 57*c* rotate about the agitating bar 49 to reach the toner discharging opening 59, and project across a length La through the toner discharging opening 59 outwardly from the toner cartridge 15 as shown in FIG. 19.

{Operation of Shutter and Vane}

Figure 20:
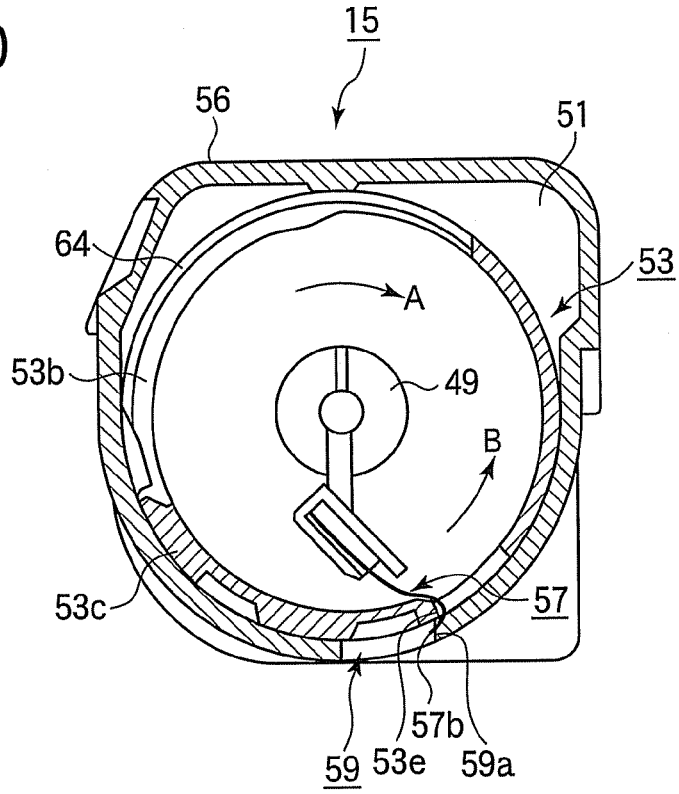
FIGS. 20 and 21 illustrate the scraper blade and the shutter when the shutter is moving toward the closing position.
Figure 21:
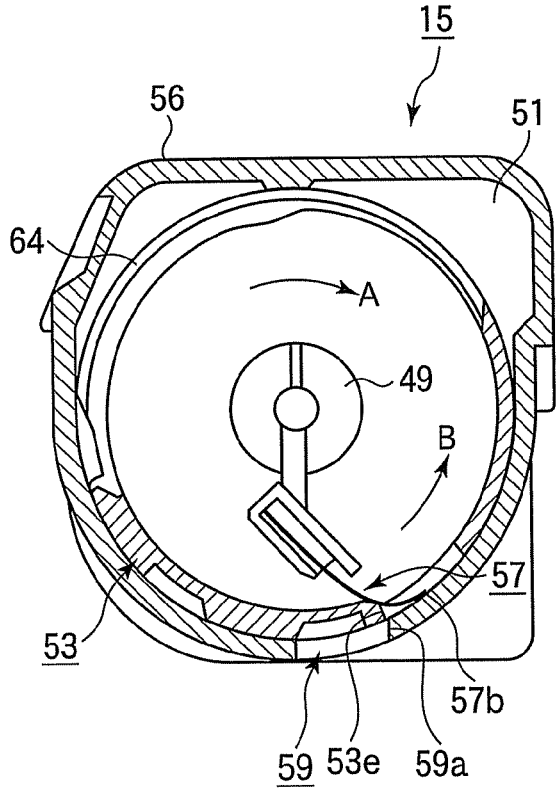

FIGS. 20 and 21 illustrate the scraper blade 57 and the shutter 53 when the shutter 53 is moving toward the closing position.

It is to be noted that the agitating bar 49 is designed to rotate only in the A direction. Referring to FIG. 20, when the lever 61 is pivoted to close the shutter 53, the perimeter 53*e* pushes the surface of the sub blades 57*c* in a direction shown by arrow B, opposite to the A direction.

Therefore, the shutter 53 moves toward the opening position with the sub blades 57*c* sliding between the shutter 53 and the inner circumferential surface of the fresh toner chamber 51.

As the shutter 53 further moves toward the closing position as shown in FIG. 21, the sub blades 57*c* will eventually resiliently escape from between the chassis 56 and the shutter 53. Thus, the shutter 53 does not remain caught between the shutter 53 and the chassis 56.

Specifically, the scraper blade 57 is mounted to the agitating bar 49 such that when the scraper blade 57 extends through the toner discharging opening 59 and an arcuate plane in which the inner circumferential wall of the fresh toner chamber 51 lies, the scraper blade 57 forms a predetermined angle with a line tangent to the arcuate plane at a position where the scraper blade 57 extends through the arcuate plane. Therefore, the shutter 53 pushes up the sub blades 57*c* while rotating toward the closing position.

Referring back to FIG. 14, the scraper blade 57 extends through the arcuate plane in which the inner circumferential wall lies, the scraper blade 57 extending through the arcuate plane at a position F and forming an angle θ with a line E tangent to the arcuate plane at the position F. The angle θ is selected to be in the range of 30 to 70 degrees, and more preferably in the range of 40 to 60 degrees.

Referring to FIG. 14, the following relation should be satisfied.

$$L3-L4>L1-L2$$

where L1 is a distance between a position 70 and the tip 57*b* when the scraper blade 57 extends straight, L2 is a distance between the position 70 and the inner circumferential surface of the fresh toner chamber, L3 is a distance over which the shutter 53 moves from a position where the perimeter 53*e* are aligned with the perimeter 59*b* to a position Q1 where the shutter 53 completely closes the toner discharging opening 59, and L4 is a distance over which the shutter 53 moves from the perimeter 59*a* to the perimeter 59*b* of the toner discharging opening 59.

The value L3-L4 is a distance over which the shutter 53 moves from the perimeter 59*a* to the position Q1 and the value L1-L2 is a distance from the tip 57*b* of the scraper blade 57 to a part of the scraper blade 57 at which the scraper blade 57 cut through an arcuate plane in which the inner circumferential surface of the fresh toner chamber lies. Alternatively, the distance the shutter 53 travels after it abuts the scraper blade 57 maybe longer than the value L1-L2.

Table 1 lists the value of angle θ and the occurrence of permanent holding of the scraper blade 57 and the performance of scraping of toner.

TABLE 1

| angle (°) | permanent holding of vane | scraping of toner |
|---|---|---|
| 90 | occurred | good |
| 80 | occurred | good |
| 70 | not occurred | good |
| 60 | not occurred | good |
| 50 | not occurred | good |
| 40 | not occurred | good |
| 30 | not occurred | good |
| 20 | not occurred | poor |

(L1 = 27 mm, L2 = 22 mm, L3 = 15 mm, L4 = 9 mm)

Figure 24:
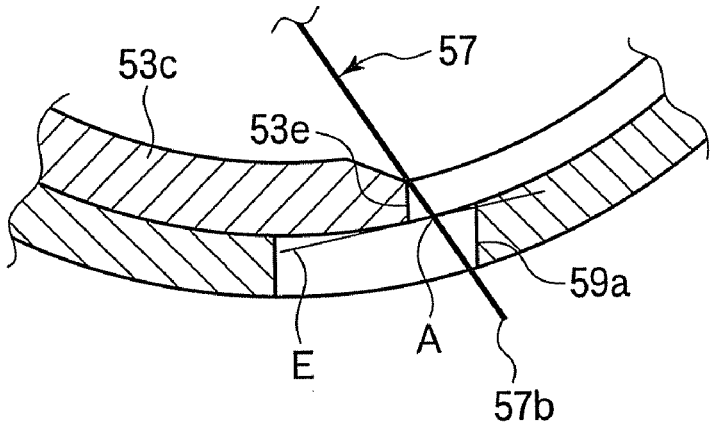
FIG. 24 illustrates the positional relation between the shutter and scraper blade when the perimeter of the opening formed in the shutter reaches the scraper blade that is at an angle larger than 70 degrees.
Figure 25:
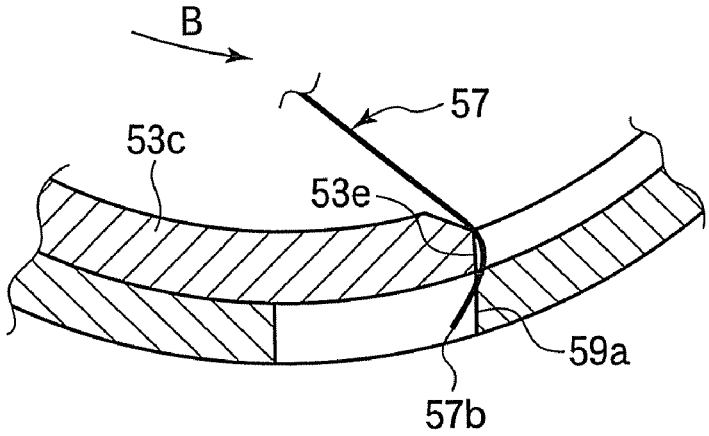
FIG. 25 illustrates the positional relation between the shutter and the scraper blade when the perimeter of the opening formed in the shutter has just traveled from one perimeter of the toner discharging opening to another.
Figure 26:
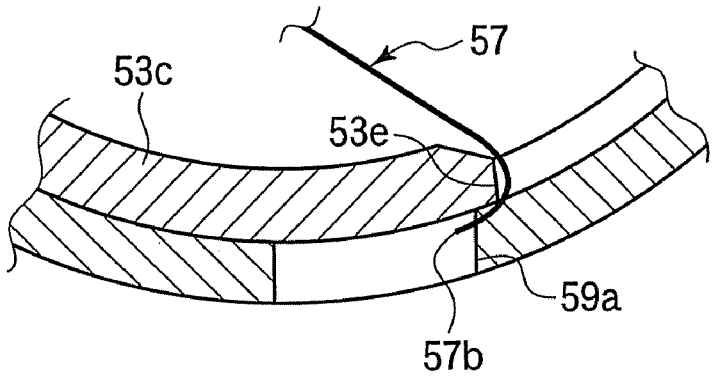
FIG. 26 illustrates the positional relation between the shutter and the scraper blade when the perimeter of the opening formed in the shutter has moved further in the closing position.
Figure 27:
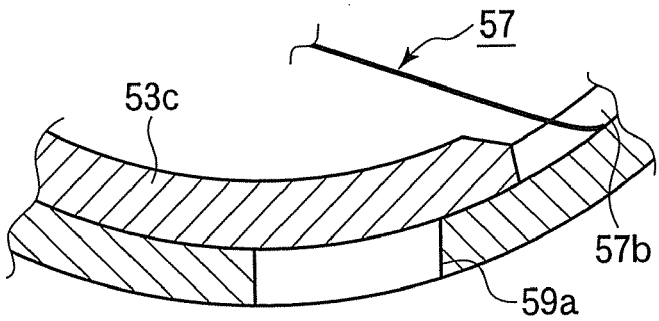
FIG. 27 illustrates the scraper blade that has reached to the closing position where the scraper blade is completely released from between the shutter and the inner circumferential wall of a fresh toner chamber.

For the angle θ (e.g., 60 degrees) not larger than 70 degrees and not smaller than 30 degrees, the scraper blade 57 and the shutter 53 operate as follows: When the shutter 53 moves in the B direction to the closing position, the perimeter 53*e* of the opening 53*a* moves toward the perimeter 59*a* of the toner discharging opening 59 to reach the scraper blade 57 as shown in FIG. 24. As the shutter 53 further moves in the B direction gradually to go up the inner circumferential wall of the fresh toner chamber 51, the perimeter 53*e* pushes the scraper blade 57 to flex, causing the scraper blade 57 to resiliently deform such that the tip 57*b* of the scraper blade 57 is pulled into the fresh toner chamber 51 through the toner discharging opening 59 as shown in FIG. 25 and FIG. 26. As the shutter further moves in the B direction, the tip 57*b* of the scraper blade 57 is released completely from between the shutter and the inner circumferential wall of the fresh toner chamber as shown in FIG. 27. Thus, the scraper blade 57 is caught between the perimeter 53*e* and the perimeter 59*a*, preventing the shutter 53 from moving any further.

When the scraper blade 57 is between the perimeters 53*e* and 59*a* as shown in FIG. 20, the shutter 53 moving in the B direction causes the scraper blade 57 to gradually escape from between the perimeters 53*e* and 59*a*. Thus, when the perimeter 53*e* has reached the position Q1 (FIG. 16), the scraper blade 57 has completely escaped from between the perimeter 53*e* and 59*a*. This prevents the scraper blade 57 from remaining between the shutter 53 and the inner circumferential surface of the toner chamber 51 to form a gap between the shutter 53 and the chassis 56. Thus, the toner will not leak from the toner cartridge 15.

Figure 23:
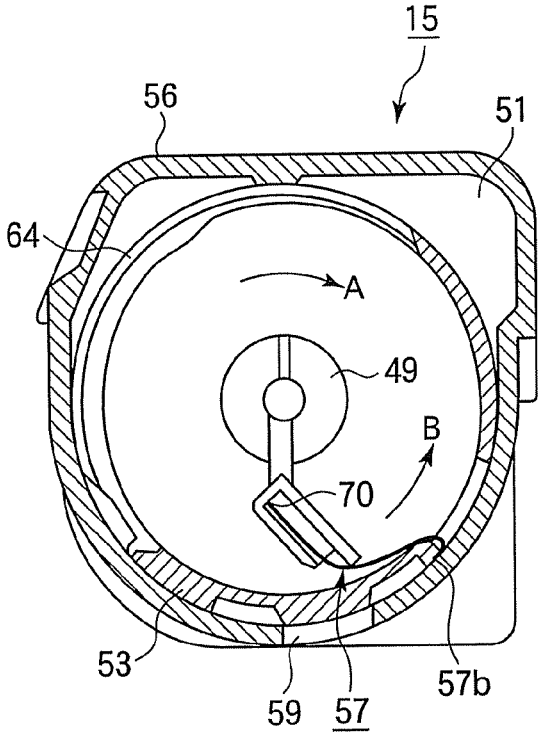
FIG. 23 illustrates the scraper blade and the shutter 53 when the shutter is moving toward the closing position further than the position in FIG. 21.

For example, assume that the angle θ is 60 degrees, L1 is 30 mm, L2 is 22 mm, L3 is 15 mm, and L4 is 9 mm. L1-L2 is longer than L3-L4. As shown in FIG. 23, a portion of the scraper blade 57 near the tip 57*b* is caught between the shutter 53 and the chassis 56.

In contrast, assume that the angle θ is 60 degrees, L1 is 27 mm, L2 is 22 mm, L3 is 15 mm, and L4 is 9 mm. L1-L2 is shorter than L3-L4. Thus, as shown in FIGS. 20 and 21, the tip 57*b* of the scraper blade 57 is safely pulled out from between the shutter 53 and the chassis 56.

Employing the angle θ in the range of 30 to 70 degrees maintains the relation L3-L4>L1-L2, so that the scraper blade 57 is prevented from remaining caught between the perimeters 53*e* and 59*a*.

As described previously, the outer sliding portion 64 of the shutter 53 engages the supporting projection 56*a* such that two arcuate bridges 53*b* resiliently urges the shutter 53 against the bottom of the fresh toner chamber 51. By the time the shutter 53 has reached the closing position and the tip 57*b* of the scraper blade 57 will have escaped from between the shutter 53 and the inner circumferential surface of the fresh toner chamber 51. There will be no gap between the shutter 53 and the chassis 56 which would otherwise be caused by the scraper blade 57 trapped between the shutter 53 and the chassis 56.

Figure 22:
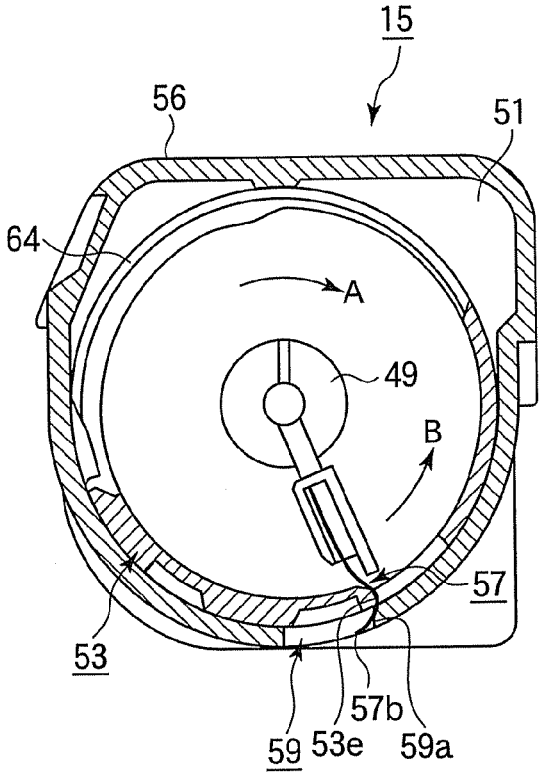
FIG. 22 illustrates the scraper blade and the shutter when the shutter is at an angle greater than 70° with a line tangent to the arcuate inner surface of a fresh toner chamber.
Figure 28:
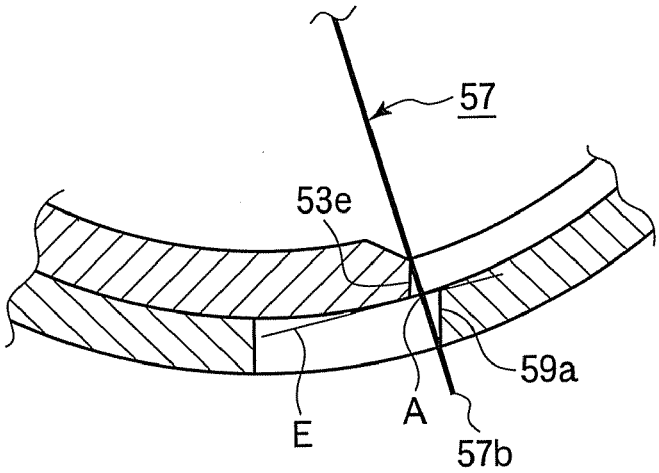
FIG. 28 illustrates the positional relation between the shutter and scraper blade when the perimeter of the opening formed in the shutter reaches the scraper blade that is at an angle larger than 70 degrees.
Figure 29:
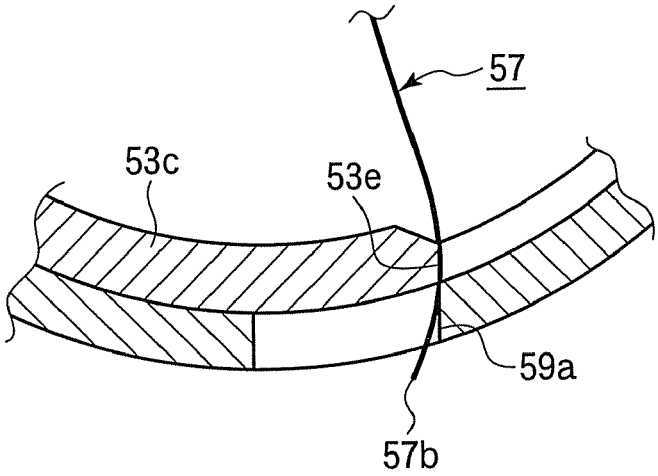
FIG. 29 illustrates the positional relation between the shutter and the scraper blade when the perimeter of the opening formed in the shutter has just traveled from one perimeter of the toner discharging opening to another.

FIG. 22 illustrates the scraper blade and the shutter when the shutter is at an angle greater than 70° with a line tangent to the arcuate inner surface of a fresh toner chamber. For the angle θ (e.g., 90 degrees) not smaller than 70 degrees, the scraper blade 57 extends in a direction at an angle larger than 70 degrees with the line E tangent to the arcuate plane as shown FIG. 22. When the shutter 53 moves in the B direction to the closing position, the perimeter 53*e* of the opening 53*a* moves toward the perimeter 59*a* of the opening 59 to reach the scraper blade 57 before the perimeter 53*e* causes the scraper blade 57 to resiliently deform sufficiently as shown in FIG. 28. Therefore, the scraper blade 57 is tightly held between the perimeter 53*e* and the perimeter 59*a* as shown in FIGS. 22 and 29. Therefore, the shutter 57 is caught between the shutter 53 and the chassis 56. The scraper blade 57 will not deform resiliently into an arcuate shape but bend or kink as shown in FIGS. 22 and 29. Then, the free end portion of the scraper blade 57 is caught between the shutter element 53*c* and the inner circumferential surface of the fresh toner chamber 51.

For the angle θ smaller than 30 degrees, the scraper blade 57 and the shutter 53 operate as follows: When the shutter 53 moves in a direction shown by arrow A to the closing position, the perimeter 53*e* of the opening 53*a* moves toward the perimeter 59*a* of the toner discharging opening 59 to reach the scraper blade 57. As the shutter 53 further moves in the B direction gradually to go up the inner circumferential wall of the fresh toner chamber 51, the perimeter 53*e* pushes the scraper blade 57 to flex, causing the scraper blade 57 to resiliently deform such that the tip 57*b* of the scraper blade 57 is pulled into the fresh toner chamber 51 through the toner discharging opening 59. Because the angle θ is smaller than 30 degrees, the perimeter 53*e* will push the scraper blade 57 to flex without difficulty. As soon as the tip 57*b* enters fresh toner chamber 51, the scraper blade 57 will resiliently deform into an arcuate shape but the tip 57*b* will not scrape the inner circumferential surface of the fresh toner chamber 51, or part of the scraper blade 57 near the tip 57*b* simply skids on the inner circumferential surface. Therefore, the scraper blade 57 makes a very small angle with the inner circumferential surface of the fresh toner chamber 51 to merely skid on the inner circumferential surface, failing to scrape off the toner adhering to the inner circumferential surface of the fresh toner chamber 51.

Because the scraper blade 57 has slits 57*a* formed therein, the tip 57*b* of the scraper blade 57 does not experience a large load when the tip 57*b* of the scraper blade 57 scrapes the inner circumferential surface of the fresh toner chamber 51 as agitating bar 49 rotates. Thus, the scraper blade 57 experiences a smaller load while still providing substantially the same scraping effect. Thus, no large torque is required for driving the agitating bar 49 in rotation.

Second Embodiment

In the first embodiment, when the user operates the rotary lever 61 to move the shutter 53 from the closing position to the opening position, the user does not know at what angular position the agitating bar 49 is.

Figure 30:
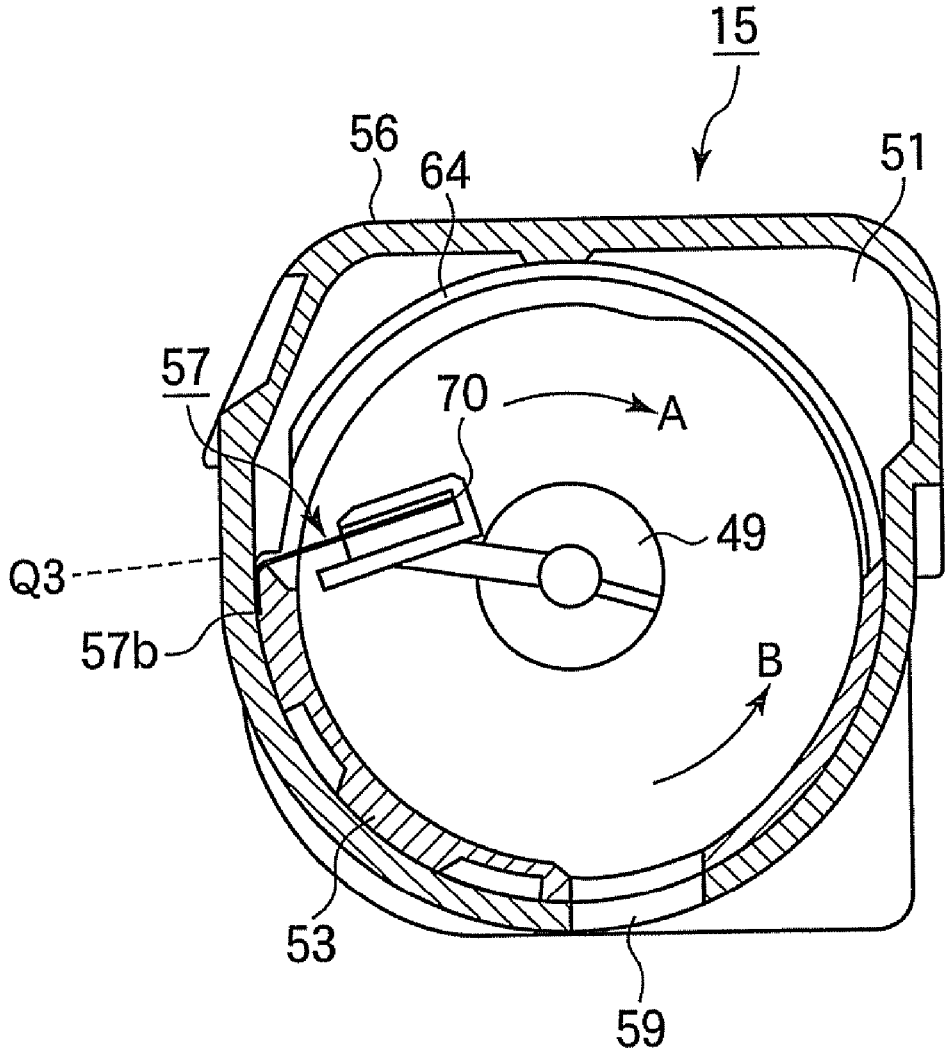
FIG. 30 illustrates the positional relation between the scraper blade and the shutter when the scraper blade remains tightly held after the shutter has moved to the opening position.

FIG. 30 illustrates the positional relation between the scraper blade 57 and the shutter 53 when the scraper blade 57 remains tightly held after the shutter 53 has moved to the opening position.

When the shutter 53 is moved from the closing position to the opening position, if the tip 57*b* of the scraper blade 57 is ahead of the shutter 53, the shutter 53 may run over the tip 57*b* of the scraper blade 57 such that the scraper blade 57 is tightly held between the shutter element 53*c* and the inner circumferential wall of the fresh toner chamber 51. As a result, the shutter 53 remains tightly held between the shutter element 53*c* and the inner circumferential wall of the fresh toner chamber 51 after the shutter 53 has moved to the opening position.

If the shutter 53 remains tightly held between the shutter element 53*c* and the inner wall of the fresh toner chamber 51, then the agitating bar 49 will no longer be able to rotate, failing to agitate the toner in the fresh toner chamber 51. Consequently, the toner adhering to the inner circumferential surface of the fresh toner chamber 51 cannot be scraped off.

A second embodiment is directed to a configuration in which when the shutter 53 is rotated in such a direction as to open a toner discharging opening 59, a scraper blade 57 in the form of a resilient sheet is prevented from being tightly held between a shutter element 53*c* and an inner circumferential surface of a fresh toner chamber 51. Elements similar to those in the first embodiment have been given the same reference numerals and their description is omitted.

Figure 31:
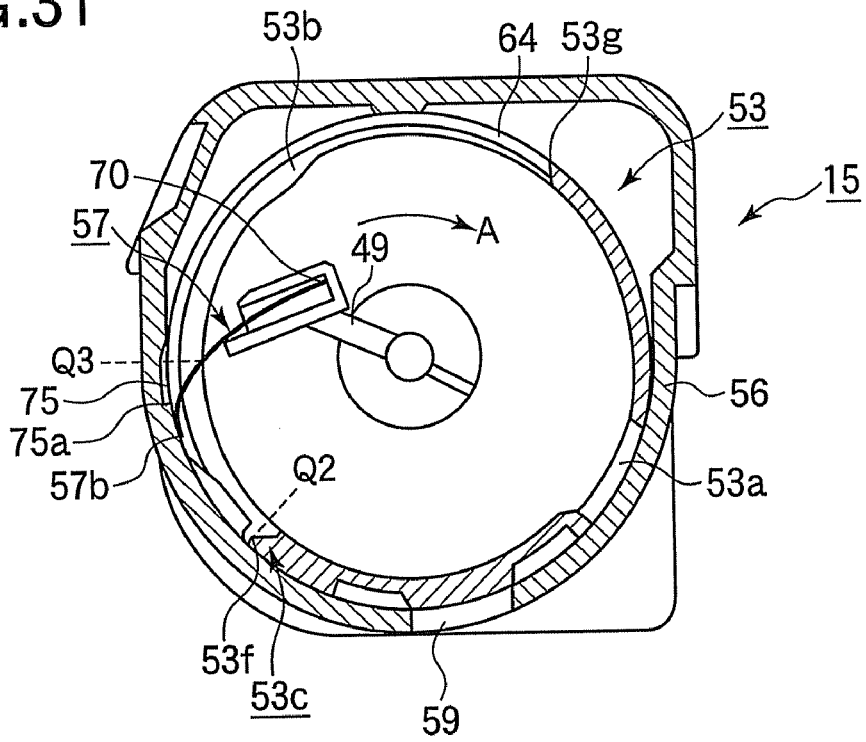
FIG. 31 is a cross-sectional view of a toner cartridge of a second embodiment when the shutter is at the closing position.

FIG. 31 is a cross-sectional view of a toner cartridge when the shutter 53 is at the closing position.

Figure 32:
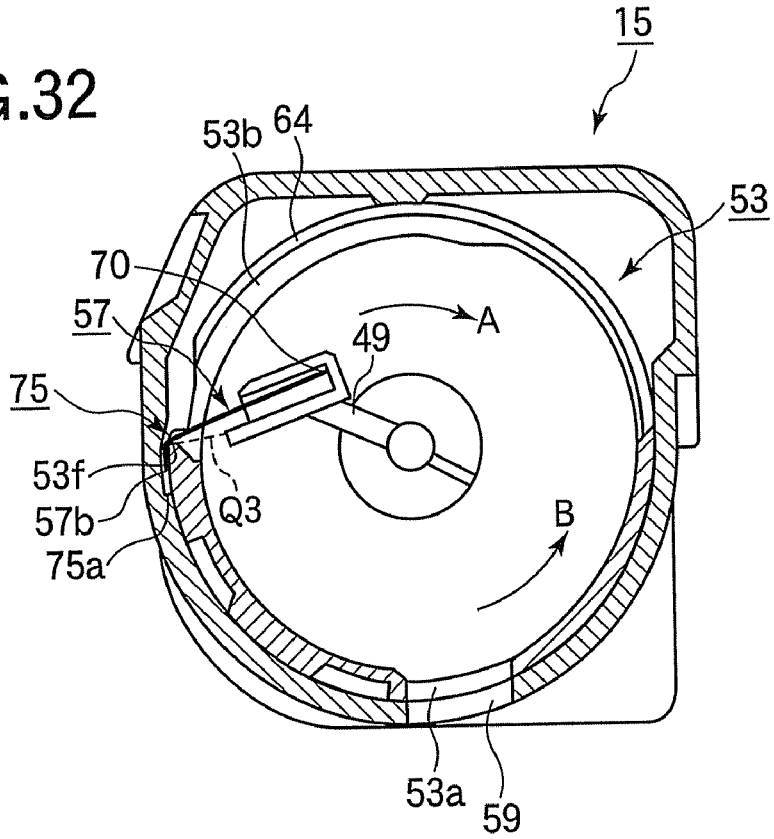
FIG. 32 is a cross-sectional view of the toner cartridge when the shutter is at the opening position.

FIG. 32 is a cross-sectional view of the toner cartridge when the shutter 53 is at the opening position.

Referring to FIGS. 31 and 32, an arcuate bridge 53*b* is connected to a shutter element 53*c* to extend across circumferential edges 53*f* and 53*g* of the shutter element 53*c*. A position Q2 is the position of the edge 53*f* when the shutter 53 is at the closing position where the shutter 53 closes the toner discharging opening 59. A position Q3 is the position of the edge 53*f* when the shutter 53 is at the opening position where the shutter 53 opens the toner discharging opening 59.

Referring to FIG. 32, when the shutter 53 is rotated in the opening direction until the edge 53*f* reaches the position Q3, if the scraper blade 57 is caught between the inner circumferential surface of the fresh toner chamber 51 and the shutter element 53*c*, the agitating bar 49 will not rotate, failing to agitate the toner in the fresh toner chamber 51.

Figure 33:
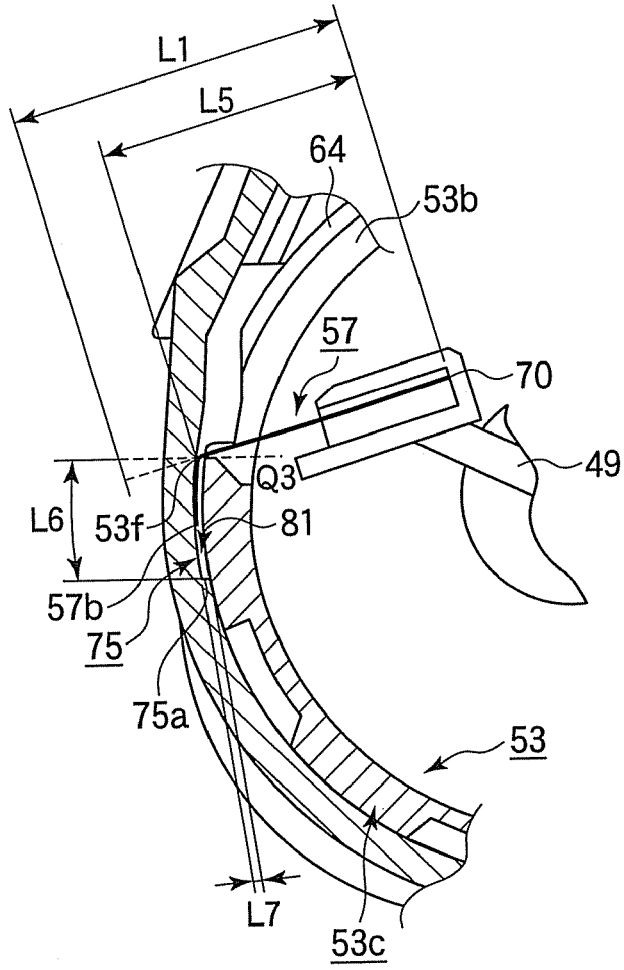
FIG. 33 is an enlarge view of a pertinent portion of FIG. 32.

FIG. 33 is an enlarge view of a pertinent portion of FIG. 32. In order to prevent the agitating bar from failing to function, a shallow recess 75 is formed in the inner wall of the fresh toner chamber 51 as shown in FIG. 33, so that when the edge 53*f* reaches the position Q3, a narrow gap 81 is defined between the inner wall of the fresh toner chamber 51 and shutter element 53*c*. A stepped portion 75*a* is formed at an upstream end of the recess 75. The recess 75 extends over a predetermined distance along the circumferential surface of the fresh toner chamber 51 from the position Q2 to the stepped portion 75*a*.

When the tip 57*b* of the scraper blade 57 takes up a position between the edge 53*f* and the position Q3, if the shutter 53 is rotated from the closing position (FIG. 31) to the opening position (FIG. 32), the tip 57*b* will enter the recess 75.

The following relation should be satisfied.

$$L6>L1-L5$$

$$L7>L8$$

where L5 is the distance from the position 70 to the position Q2, L6 is the distance between the position Q3 and the stepped portion 75*a*, L7 is the height of the stepped portion 75*a*, and L8 is the thickness of the scraper blade 57. The value L1-L5 is the length of a portion of the scraper blade 57 that has entered in the recess 75.

Figure 34:
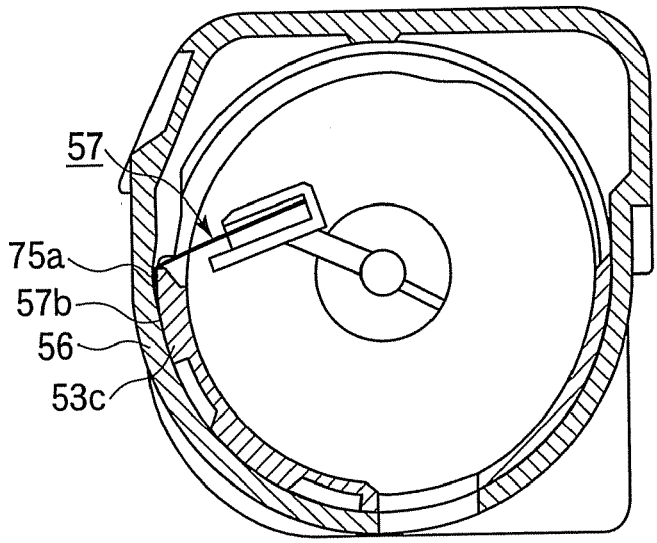
FIG. 34 illustrates the scraper blade caught between the shutter and the inner circumferential wall of the fresh toner chamber.

If the value L6 is smaller than L1-L5, the tip 57*b* of the scraper blade 57 is upstream of the stepped portion 75*a* with respect to rotation of the agitating bar 49. Thus, as shown in FIG. 34, the tip portion of the scraper blade 57 is caught between the shutter element 53*c* and the inner circumferential surface of the fresh toner chamber 51. Therefore, the value L6 is required to be larger than L1-L5.

If the thickness L8 is larger than height L7, the scraper blade 57 is caught and compressed between the bottom surface of the recess 75 and the shutter element 53*c*, so that the scraper blade 57 is compressed. For this reason, it is required that L7>L8.

If L1=27 mm, L5=22 mm, L6=7 mm, L7=0.5 mm, and L8=0.1 mm, the scraper blade 57 will not be caught between the inner circumferential surface of the fresh toner chamber 51 and shutter element 53*c* (FIG. 32). If L1=27 mm, L5=22 mm, L6=3 mm, L7=0.5 mm, and L8=0.1 mm, the scraper blade 57 will be caught at about 2 mm from the tip 57*b* between the shutter element 53*c* and the inner circumferential surface of the fresh toner chamber 51 as shown in FIG. 34.

As described above, when the shutter 53 is rotated in the opening direction, the recess 75 receives the scraper blade 57 to prevent the scraper blade 57 from being tightly held between the shutter 53 and the inner circumferential surface of the fresh toner chamber 51.

Thus, the agitating bar 49 can be rotated to reliably agitate the toner in the fresh toner chamber 51 without any obstacle, and can scrape the toner adhering to the inner circumferential wall of the fresh toner chamber 51.

As the shutter 53 opens the toner discharging opening 59, the tip 57*a* of the scraper blade 57 enters the recess 75 so that no mechanical load is exerted on the scraper blade 57. This ensures that the shutter 53 opens the toner discharging opening 59 reliably every time the shutter 53 is operated. Thus, the chassis 59 may be recycled.

Modification to Second Embodiment

In the second embodiment, when the shutter 53 is at the closing position (FIG. 31), the tip 57*b* is between the stepped portion 75*a* and the position Q2 of the edge 53*f*. If the shutter 53 is rotated from the closing position toward the opening position, the agitating bar 49 is rotated in the A direction with the end portion near the tip 57*b* caught between the shutter 53 and the inner circumferential wall of a fresh toner chamber 51 until the edge 53*f* reaches the stepped portion 75*a*. When the edge 53*f* reaches the position Q3 (FIG. 32), the end portion near the tip 57*b* is finally released from between the shutter 53 and the inner circumferential wall 56.

When the scraper blade 57 caught between the shutter 53 and the inner circumferential wall of the fresh toner chamber moves along the inner circumferential wall 56, a large mechanical force is exerted on the scraper blade 57 causing the scraper blade 57 to wear. As a result, the scraper blade 57 can no longer scrape the toner from the inner wall of the fresh toner chamber, being disadvantageous to recycling of the toner cartridge.

A modification to the second embodiment is directed to a configuration in which a scraper blade 57 is subjected to as small a mechanical stress as possible. Elements similar to those in the first to second embodiments have been given the same reference numerals and their description is omitted.

Figure 37:
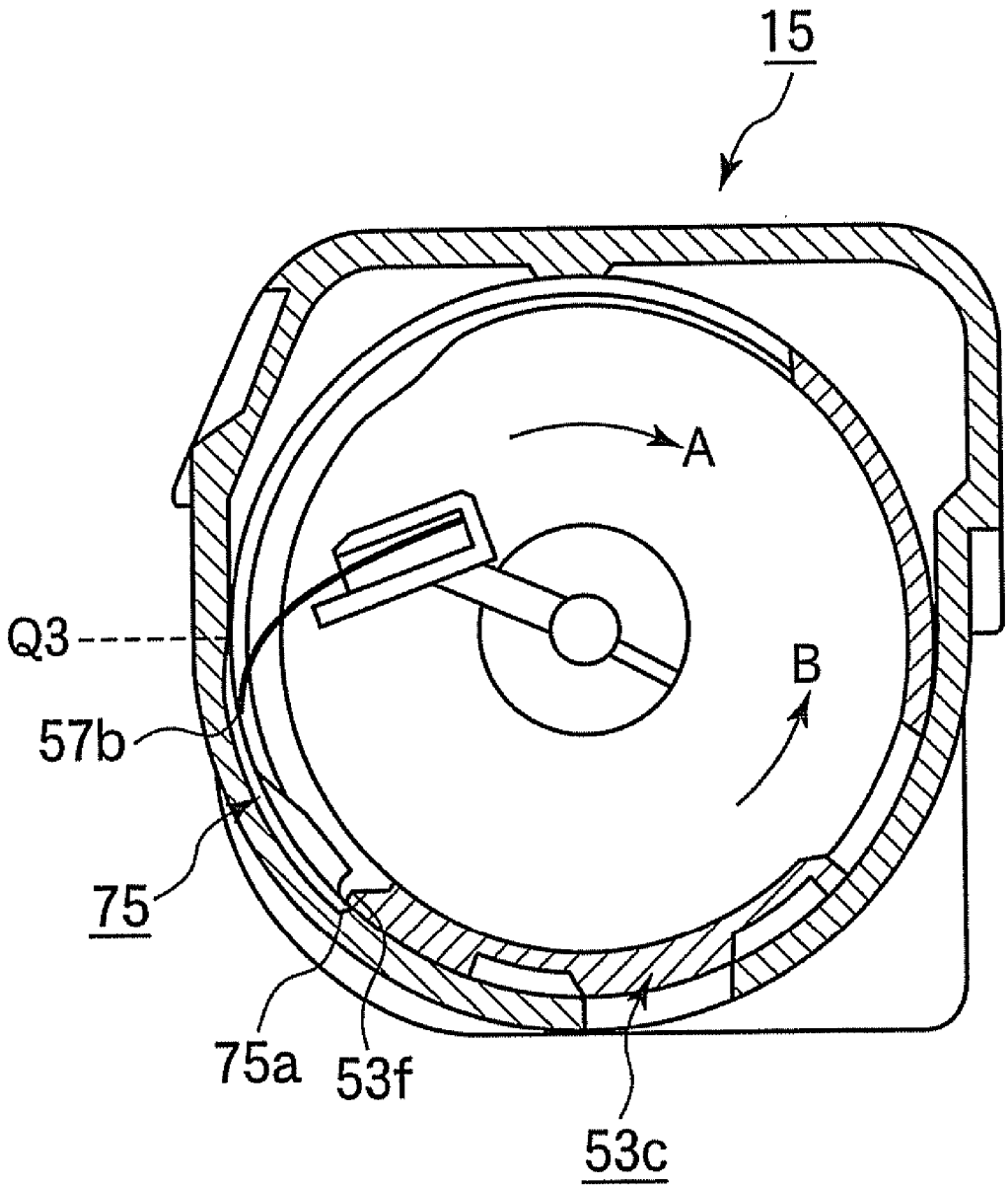
FIG. 37 is a cross-sectional view of a toner cartridge illustrating a shutter when the shutter is at its closing position.

FIG. 37 is a cross-sectional view of a toner cartridge 15 illustrating a shutter 53 when the shutter 53 is at its closing position.

A recess 85 is formed to extend at least from a position Q2 to a position Q3. Thus, when the shutter 53 rotates in the opening direction, the tip 57*b* of the scraper blade 57 will not be tightly held between the shutter 53 and the inner circumferential surface of the fresh toner chamber 51.

The recess 85 prevents the tip 57*b* of the scraper blade 57 from being worn out, allowing the toner cartridge 15 to be recycled.

In the second embodiment and the modification to the second embodiment, the recess 75 is formed in the inner surface of the fresh toner chamber 51. Instead, a recess may be formed both in the outer surface of the shutter elements 53*c* and in the inner surface of the fresh toner chamber 51.

Third Embodiment

Elements similar to those in the first and second embodiments have been given the same reference numerals and their description is omitted.

Figure 35:
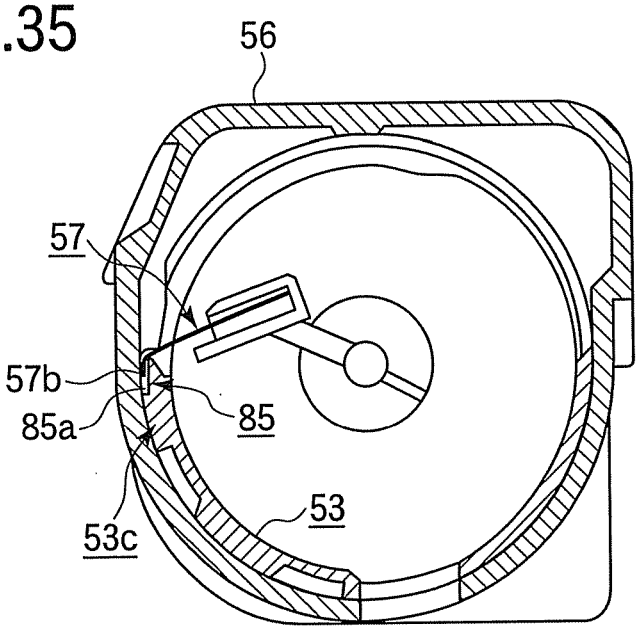
FIG. 35 is a cross-sectional view of a toner cartridge illustrating a shutter when it is opened.

FIG. 35 is a cross-sectional view of a toner cartridge 15 illustrating a shutter 53 when it is opened.

Figure 36:
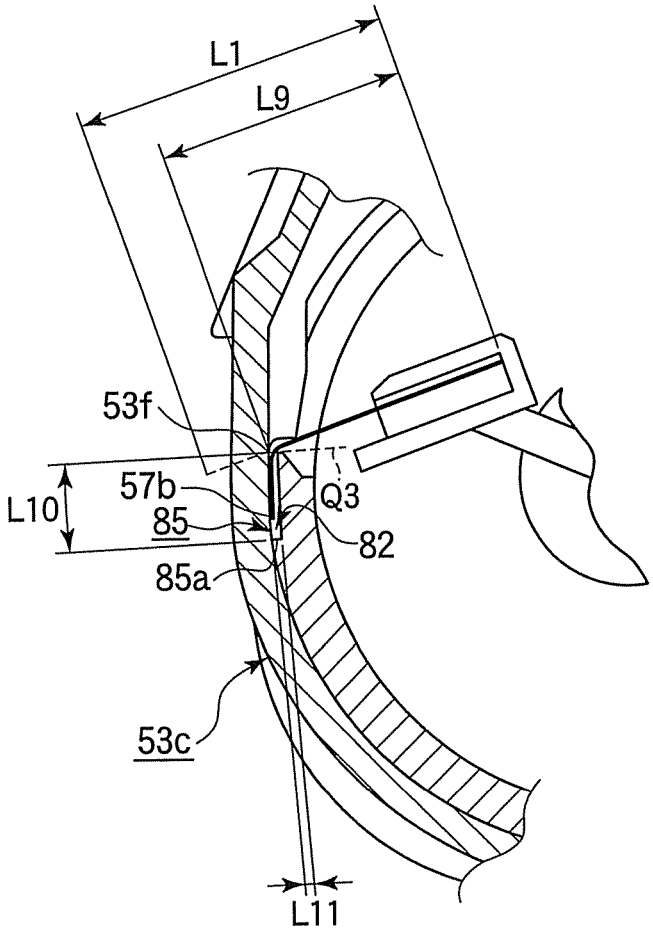
FIG. 36 is a partial enlarged cross-sectional view of FIG. 35.

FIG. 36 is a partial enlarged cross-sectional view of FIG. 35.

A recess 85 is formed in the outer circumferential surface of the shutter 53 such that a space or gap 82 is defined between the shutter element 53*c* and the inner circumferential surface of a fresh toner chamber 51. The shutter 53 is formed with a stepped portion 85*a* at an upstream end of the recess 85.

The following relation should be satisfied.

$$L10>L1-L9$$

$$L11>L8$$

where L9 is the distance from the position 70 to the position Q3, L10 is the distance between an edge 53*f* and the stepped portion 85*a*, and L11 is the height of the stepped portion 85*a*. The value L1-L9 is substantially equal to the length of a free end portion of the scraper blade 57 lying in the recess 85.

In the third embodiment, the recess 85 is formed in the inner surface of the fresh toner chamber 51. Instead, a recess may be formed both in the outer surface of the shutter elements 53*c* and in the inner surface of the fresh toner chamber 51.

While the first to third embodiments and modification to the second embodiment have been described with respect to the image forming unit 10 and the toner cartridge 15 that are separate assemblies, they can be designed in an integral structure.

While the embodiments have been described in terms of a printer, the invention may also be applicable to a facsimile machine, a copying machine, and a combination of these.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A developer cartridge, comprising:

a chamber holding a developer therein and including an inner surface and an opening through which the developer is discharged;

a rotating body rotatably supported in said chamber;

a resilient scraper blade having one end fixed to said rotating body and extending away from said rotating body, a free end of said scraper blade scraping the surface when said rotating body rotates, wherein when said scraper blade extends in a first direction through the opening and a plane in which the inner surface lies, the first direction forming an acute angle with the plane at a position where the scraper blade extends through the plane; and a shutter movable in sliding contact with the inner surface of said chamber, said shutter including an outer surface slidable on the inner surface between a closing position where said shutter closes the opening and an opening position where said shutter opens the opening, said shutter being on an acute angle side of said scraper blade and moving from the opening position to the closing position toward the scraper blade.

2. The developer cartridge according to claim 1, wherein the angle is not larger than 70 degrees.

3. The developer cartridge according to claim 1, wherein the angle is not smaller than 30 degrees.

4. The developer cartridge according to claim 1, wherein said scraper blade and shutter are related such that $$L3-L4>L1-L2$$

where L1 is a total length of said scraper blade,

L2 is a distance from the one end fixed to said rotating body to the plane when said scraper blade extends in the first direction through the plane, L3 is a distance over which the shutter moves from the opening position to the closing position, and L4 is a distance over which the shutter moves across the first opening.

5. The developer cartridge according to claim 1, wherein when said shutter is at the closing position, the shutter and said chamber define a space between the inner surface and said shutter.

6. The developer cartridge according to claim 5, wherein the space is defined by a stepped portion recessed from the inner surface of said chamber.

7. A developer cartridge, comprising:

a chamber holding a developer therein and including an inner surface and a first opening through which the developer is discharged;

a shutter movable in slide contact with the inner surface of said chamber, said shutter being movable either to a closing position where said shutter closes the first opening or to an opening position where said shutter opens the first opening, wherein when said shutter is at the closing position, the shutter and said chamber define a space between the inner surface and said shutter, the space being defined by a stepped portion recessed from the inner surface of said chamber;

a rotating body rotatably supported in said chamber; and a resilient scraper blade having one end fixed to said rotating body and extending away from said rotating body, a free end of said scraper blade scraping the surface when said rotating body rotates, wherein when said scraper blade extends in a first direction through the first opening and a plane in which the surface lies, the first direction forming an acute angle with the plane at a position where the scraper blade extends through the plane;

wherein said scraper blade and said shutter are related such that $$L6>L1-L5$$

$$L7>L8$$

where L1 is a total length of said scraper blade,

L5 is a distance from the one end fixed to said rotating body to a bottom of the stepped portion, L6 is a distance over which the stepped portion extends substantially in a second direction in which said shutter moves from the closing position to the opening position, the stepped portion extending such that when said shutter moves in the second direction, said shutter faces stepped portion, L7 is a depth of the stepped portion, and L8 is a thickness of said scraper blade.

8. The developer cartridge according to claim 5, wherein said shutter includes a stepped portion recessed from a surface of said shutter facing the inner surface of said chamber.

9. A developer cartridge, comprising:

a chamber holding a developer therein and including an inner surface and a first opening through which the developer is discharged;

a shutter movable in slide contact with the inner surface of said chamber, said shutter being movable either to a closing position where said shutter closes the first opening or to an opening position where said shutter opens the first opening, wherein when said shutter is at the closing position, the shutter and said chamber define a space between the inner surface and said shutter, said shutter including a stepped portion recessed from a surface of said shutter facing the inner surface of said chamber;

a rotating body rotatably supported in said chamber; and a resilient scraper blade having one end fixed to said rotating body and extending away from said rotating body, a free end of said scraper blade scraping the surface when said rotating body rotates, wherein when said scraper blade extends in a first direction through the first opening and a plane in which the surface lies, the first direction forming an acute angle with the plane at a position where the scraper blade extends through the plane;

wherein said scraper blade and said shutter are related such that $$L10>L1-L9$$

$$L11>L8$$

where L1 is a total length of said scraper blade,

L9 is a distance from the one end fixed to said rotating body to a bottom of the stepped portion, L10 is a distance over which the stepped portion extends substantially in a second direction in which said shutter moves from the closing position to the opening position, the stepped portion extending such that when said shutter moves in the second direction, said shutter faces stepped portion, L11 is a depth of the stepped portion, and L8 is a thickness of said scraper blade.

10. The developer cartridge according to claim 1, wherein said scraper blade is a sheet of a resilient material.

11. An image forming unit incorporating said developer cartridge according to claim 1, wherein the image forming unit comprising a developer bearing body that bears developer thereon, and a developer supplying member that supplies the developer to the developer bearing body.

12. The image forming unit incorporating said developer cartridge according to claim 11, wherein the angle is not larger than 70 degrees.

13. The image forming unit incorporating said developer cartridge according to claim 11, wherein the angle is not smaller than 30 degrees.

14. The image forming unit incorporating said developer cartridge according to claim 11, wherein said scraper blade and shutter are related such that $$L3\text{-}L4>L1\text{-}L2$$

where L1 is a total length of said scraper blade,

L2 is a distance from the one end fixed to said rotating body to the plane when said scraper blade extends in the first direction through the plane, L3 is a distance over which the shutter moves from the opening position to the closing position, and L4 is a distance over which the shutter moves across the first opening.

15. The image forming unit according to claim 11, wherein said developer cartridge is detachably attached to the image forming apparatus.

16. An image forming apparatus incorporating said developer cartridge according to claim 1, comprising:

an image forming unit that forms a developer image;

a transfer section that transfers the developer image onto a medium; and a fixing section that fixes the developer image on the medium into a permanent image.

17. The image forming apparatus according to claim 16, wherein the angle is not larger than 70 degrees.

18. The image forming apparatus according to claim 16, wherein the angle is not smaller than 30 degrees.

19. The image forming apparatus according to claim 16, wherein said scraper blade and shutter are related such that $$L3\text{-}L4>L1\text{-}L2$$

where L1 is a total length of said scraper blade,

L2 is a distance from the one end fixed to said rotating body to the plane when said scraper blade extends in the first direction through the plane, L3 is a distance over which the shutter moves from the opening position to the closing position, and L4 is a distance over which the shutter moves across the first opening.

20. The developer cartridge according to claim 1, wherein the inner surface is partially cylindrical and the outer surface is partially cylindrical.

21. The developer cartridge according to claim 1, wherein the scraper blade extends in a direction off an axis about which said rotating body rotates.

* * * * *